US005294532A

United States Patent [19]

Ito et al.

[11] Patent Number: 5,294,532

[45] Date of Patent: Mar. 15, 1994

[54] SILVER HALIDE PHOTOGRAPHIC MATERIAL AND METHOD OF PROCESSING THE SAME

[75] Inventors: Tadashi Ito; Takanori Hioki; Akihiko Ikegawa, all of Kanagawa, Japan

[73] Assignee: Fuji Photo Film Co., Ltd., Kanagawa, Japan

[21] Appl. No.: 945,922

[22] Filed: Sep. 17, 1992

[30] Foreign Application Priority Data

Sep. 19, 1991 [JP] Japan ..... 3-266934
Sep. 19, 1991 [JP] Japan ..... 3-266959

[51] Int. Cl.[5] ..... G03C 1/09; G03C 1/18
[52] U.S. Cl. ..... 430/588; 430/605
[58] Field of Search ..... 430/588, 605

[56] References Cited

U.S. PATENT DOCUMENTS 4,621,041 11/1986 Saikawa et al. ..... 430/588

FOREIGN PATENT DOCUMENTS 2330602 1/1974 Fed. Rep. of Germany ..... 430/605

*Primary Examiner*—Janet C. Baxter

[57] ABSTRACT

Disclosed is a silver halide photographic material for medical use, in which the coated amount of silver per surface of the support is 2.8 g/m$^2$ or less, the silver halide grains in the coated silver halide emulsion layer have a silver chloride content of 10 to 50 mol %, they contain $10^{-8}$ mol or more, per mol of silver, of an iridium compound and they have been spectrally-sensitized to be sensitive to rays of from 600 to 700 nm wavelength range. The material may be processed by rapid processing and has a high sensitivity and high covering power.

Also disclosed is a silver halide photographic material for laser exposure, in which the emulsion contains $10^{-8}$ mol or more, per mol of silver, of an iridium compound and is spectrally-sensitized with a sensitizing dye of formula (III):

(III)

$(M_1)m_1$ where $V_1$, $V_2$, $V_3$, $V_4$, $V_5$, $V_6$, $V_7$ and $V_8$ each represent a hydrogen atom or a monovalent substituent, and they satisfy the following conditions:
where f value of Vk (k=1 to 8) is Vkf,
$A_1=V_1f+V_2f+V_3f+V_4f$, and
$A_2=V_5f+V_6f+V_7f+V_8f$;
then $A_1<1.63$, or $A_2<1.63$;

$R_1$ and $R_2$ each represent a substituted or unsubstituted alkyl group;

$L_1$, $L_2$ and $L_3$ each represent a substituted or unsubstituted methine group;

$M_1$ represents a charge neutralizing pair ion; and $m_1$ is a number of 0 or more, which is necessary for neutralizing the charge of the molecule.

This has high sensitivity and may be processed by ultra-rapid processing system to result in little residual color in the processed material.

3 Claims, No Drawings

SILVER HALIDE PHOTOGRAPHIC MATERIAL AND METHOD OF PROCESSING THE SAME

FIELD OF THE INVENTION

The present invention relates to a silver halide photographic material for medical use and, in particular, one which may be rapidly processed and which has a high covering power. The invention also relates to a method of processing that material.

The present invention also relates to a silver halide photographic material for laser exposure and, in particular, to one which may be processed by ultra-rapid processing, and to a method of processing that material.

BACKGROUND OF THE INVENTION

Laser imagers, in which an image is recorded in a photographic material by laser ray scanning, have become popular as a system for recording an output image from a diagnostic instrument such as X-ray CT or MRI (nuclear magnetic resonance instrument). The laser imager system must record and develop the output image in a shorter period of time to obtain a rapid diagnosis.

Known recording lasers used as laser imagers, are He-Ne and semiconductor lasers.

The wavelength range of rays for exposure with a laser imager is, for example, from 600 to 700 nm with a He-Ne laser and an AlGaP (semiconductor) laser and within the infrared range of semiconductors. Of them, a laser imager operated with exposing rays of from 600 to 700 nm has become most popular, since the rays are within the visible range and therefore an optical system with them may be more easily adjusted than one with infrared rays.

However, a laser imager system must use photographic materials containing visible color sensitizing dyes. Additionally, the materials should be more suited to rapid processing than infrared-sensitive photographic materials, especially with respect to the harmful color retention in materials which have been subjected to rapid processing.

To reduce residual color in processed photographic materials, the amount of the dyes therein may be reduced. In accordance with this method, however, the sensitivity of the materials unfavorably lowers. In another method, color retention is reduced by incorporating an adsorbent in the materials. However, this method is also defective in that it reduces residual color by the substantial substitution of the dyes with added adsorbent on the surfaces of silver halide grains in the materials, with an inevitable lowering of the sensitivity of the materials.

The photographic materials to be used with a laser imager should have various characteristics. In particular, since they are exposed in a short period of time of from $10^{-7}$ to $10^{-3}$ second, they must be highly sensitive.

It is known that the output image from a laser imager has portions having a distinctly different density from that of the areas adjacent to the image. These portions cause unevenness in the developed image when developed by rapid development with an automatic processor. Since this may be avoided by promoting the developability of the photographic material to be used therein, it is necessary that the fluctuation of the sensitivity of the photographic material caused by variation of development time is small.

Recently, high temperature rapid processing of photographic materials has become popular, and the processing time of various photographic materials with an automatic machine has been remarkably shortened. In order to attain rapid processing, a developer is needed which is capable of yielding a sufficient sensitivity in a short period of time. Also needed is a photographic material which has a high rate of development to yield a sufficient density in a short period of time and which may be dried in a short period of time after rinsing. In a method which is generally satisfactorily employed for the purpose of improving the easy driability of photographic materials, a suitable amount of a hardening agent (gelatin crosslinking agent) is previously added to the photographic material in the coating step during its preparation, so that the swelling rate of the emulsion layer and the hydrophilic colloid layer constituting the material so that the water content in the processed photographic material before initiation of drying is reduced during the process of development, fixation and rinsing. In accordance with the method, when a larger amount of a hardening agent is added to the material, the drying time may be shortened. However, in the method, the swelling rate of the layers constituting the material is lowered so that development of the material is delayed, causing depression of sensitivity and hardness or to cause depression of the covering power. In addition to this method, other rapid processing methods are known, for example, as described in JP-A 63-136043 (the term "JP-A" as used herein means an "unexamined published Japanese patent application"), in which a developer and a fixer both having substantially no gelatin-hardening effect are used. The method is advantageous in promoting the rate of development and the rate of fixation with the processing solutions, while it delays the rate of drying. Therefore, the method could not be said to be sufficiently effective.

On the other hand, as a method of promoting the rate of development and enhancing covering power, the addition of various additives to silver halides is known. For instance, such additives include polyacrylamides as polymer additives in U.S. Pat. Nos. 3,271,158 and 3,514,289 dextran compounds, as saccharide additives, in U.S. Pat. Nos. 3,063,838 and 3,272,631. However, when these compounds are added to photographic materials in such a amount as to sufficiently satisfy the objects, the driability of the materials and this film strength would defectively lower.

Apart from rapid processability, further elevation of the sensitivity and covering power of photographic materials is a goal which has heretofore been sought in this technical field. When elevation of the sensitivity of photographic materials is realized by enlarging the grain size of the silver halide grains therein, this covering power generally lowers. Therefore, if elevation of the sensitivity of photographic materials could not be attained by the use of silver halide grains having the same grain size or if elevation of the covering power thereof could not be attained by the use of silver halide grains having the same sensitivity, then such a result would be meaningless.

Under these circumstances, photographic materials having a high sensitivity and a high covering power and having a high rate of development with rapid processability are desired as those for popular laser imagers which may be easily subjected to optical adjustment and which have an ordinary exposure range of from 600 to 700 nm.

On the other hand, even though the rate of development of photographic materials could be elevated, delay in fixation of the materials due to excess hardening of them would cause other problems of silver remains, hypo remains and residual color from the sensitizing dyes used, which preclude shortening of the processing time.

Some methods of elevating the activity of processing solutions are also known. For instance, effective are increases in the amounts of the developing agent and the developing aid in a developer, elevation of the pH value of a developer, and elevation of the processing temperature. However, all of these methods have the drawbacks that the time-dependent stability of the processing solutions is lowered and the processed materials are often softened or quite fogged.

In addition, in accordance with the proposed methods in which the processing time of development, fixation and rinsing is shortened, photographic sensitivity is lowered, and silver and hypo residues increase due to depression of the fixing capacity. For spectrally-sensitized photographic materials, these methods have the additional problem of residual color due to the sensitizing dyes therein.

SUMMARY OF THE INVENTION

One object of the present invention is to provide a silver halide photographic material having excellent developability and sensitivity and having a high covering power, while containing silver halide grains of an ordinary size (measured by the diameter of projected area), and further having excellent fixability with rapid processability and a spectral sensitivity in the range of from 600 to 700 nm. The invention also relates to a method of processing the material.

Another object of the present invention is to provide a silver halide photographic material for laser exposure, which may be processed well by rapid processing. The material has high sensitivity and high developability and has been improved to such a level that it is free from the problem of residual color from sensitizing dyes therein.

In a first embodiment of the present invention, a silver halide photographic material comprises a transparent support having on at least one surface thereof a light-sensitive silver halide emulsion layer, wherein the silver halide emulsion is present in a coated amount of 2.8 g/m$^2$ or less as silver per surface of the support, and wherein the silver halide emulsion (i) contains grains which have a silver chloride content of from 10 mol % to 50 mol % based on the total amount of silver halide, (ii) contains an iridium compound in an amount of $10^{-8}$ mol or more per mol of silver in the silver halide, and (iii) has been spectrally-sensitized to be sensitive to rays with a wavelength range of from 600 to 700 nm.

Preferably, the silver halide emulsion in the material is gold-sensitized.

In a second embodiment of the present invention, a silver halide photographic material comprises a light-sensitive silver halide emulsion layer on at least one surface of a transparent support, wherein the silver halide emulsion contains an iridium compound in an amount of $10^{-8}$ mol or more per mol of silver in the silver halide therein and has been spectrally-sensitized with a sensitizing dye of general formula (III):

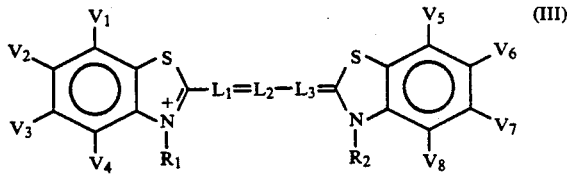

(III)

where $V_1$, $V_2$, $V_3$, $V_4$, $V_5$, $V_6$, $V_7$ and $V_8$ each represent a hydrogen atom or a monovalent substituent, and they satisfy the following conditions:
where f value of Vk (k=1 to 8) is Vkf,
$A_1=V_1f+V_2f+V_3f+V_4f$, and
$A_2=V_5f+V_6f+V_7f+V_8f$;
then $A_1<1.63$, or $A_2<1.63$;

$R_1$ and $R_2$ each represent a substituted or unsubstituted alkyl group;

$L_1$, $L_2$ and $L_3$ each represent a substituted or unsubstituted methine group:

$M_1$ represents a charge neutralizing pair ion; and $m_1$ is a number of 0 or more, which is necessary for neutralizing the charge of the molecule.

DETAILED DESCRIPTION OF THE INVENTION

The embodiments of the present invention will be explained below.

The area ratio of (100) plane to (111) plane in the silver halide grains for use in the present invention is preferably 3 or more, more preferably 4 or more, further preferably 5 or more. The ratio may be 100% of (100) plane. Preferably, the content of silver halide grains having a ratio of (100) plane to (111) plane of being 3 or more, preferably 5 or more, in the light-sensitive silver halide for use in the present invention, is 50% by weight or more, especially preferably 80% by weigh or more.

Silver halide grains having a ratio of (100) plane to (111) plane for use in the present invention may be prepared by various methods. The most common one is a so-called controlled double jet method in which the pAg value in the system for forming the grains is kept at a constant value of 8.1 or less, and an aqueous solution of silver halide and an aqueous solution of alkali halide(s) are simultaneously added to the system, both at a rate higher than the dissolution rate of the grains and at a rate not causing renucleation. More preferably, the pAg value in the system is kept to be 7.8 or less, especially preferably 7.6 or less. The pAg value in the formation of silver halide nuclei in the method is not specifically defined, but the pAg value in growth of the grains is desired to be 8.1 or less, preferably 7.8 or less, more preferably 7.6 or less. As a system of reacting an aqueous silver halide solution and aqueous alkali halide solution(s), a single jet method may be employed. However, a double jet method is more preferred for the system for obtaining good monodispersed grains.

The silver halide grains in the emulsion of the present invention may be either coarse grains or fine grains or may also be a mixture of the two. Preferably, they are emulsion grains having a mean grain size (for example, as measured by a projected area measuring method or a number average measuring method) of approximately from 0.04μ to 1.0μ, preferably from 0.2μ to 0.7μ.

The shape of the grains is desired to be cubic, which, however, may be any other spherical, pebble-like or tabular (For instance, the grains may be tabular grains having an aspect ratio of 5 or more (which are described in detail in, for example, *Research Disclosure,* Item No. 22534, pages 20 to 58)) or the like irregular crystalline one. The light-sensitive silver halide emulsion may be used as a mixture with a substantially non-light-sensitive silver halide emulsion (for example, an emulsion of inside-fogged fine grains). Needless to say, a plurality of emulsions each having a different grain size and a different halogen composition may be coated to form different layers on a support, for the purpose of enlarging the exposure latitude of the photographic material.

Regarding the grain size distribution, a so-called monodispersed emulsion having a narrow grain size distribution is preferred. Specifically, preferred is a monodispersed emulsion in which 90% or more of the total grains therein have a grain size falling within the range of the mean grain size ±40%, more preferably within the range of a mean grain size ±20%.

Regarding the crystal structure of the silver halide grains for use in the present invention, they may have a uniform crystal structure throughout the grain, or they may have a layered crystal structure in which the inside and the outside of the grain have a different crystal structures, or they may also have a conversion type crystal structure as described in British Patent 635,841 and U.S. Pat. No. 3,622,318. The grains may be so-called surface latent image grains which form a latent image essentially on the surface of the grain or so-called inside latent image grains which form it in the inside of the same.

The light-sensitive silver halide used in the first embodiment of the present invention includes silver halides of chlorine, bromine and/or iodine such as silver chlorobromide or silver chloroiodobromide. Where silver chloroiodobromide is used, it has a silver iodide content of generally from 0 to 3 mol %, preferably from 0 to 1 mol %, and has a silver chloride content of from 10 to 50 mol %, preferably from 15 to 40 mol %. Where silver chlorobromide is used, it has a silver chloride content of from 10 to 50 mol %, preferably from 15 to 40 mol %.

In the second embodiment of the present invention containing the dye of general formula (III), the light-sensitive silver halide of constituting the photographic material may be selected from silver halides of chloride, bromide and/or iodides, such as silver chloride, silver bromide, silver iodobromide, silver chlorobromide or silver chloroiodobromide. Where it is silver iodobromide or silver chloroiodobromide, the silver iodide content therein may be generally from 0 to 3 mol %, preferably from 0 to 1 mol %, and the silver chloride content therein may be generally from 0 to 50 mol %, preferably from 0 to 30 mol %. Where it is silver chlorobromide, the silver chloride content therein may be generally from 0 to 98 mol %, preferably from 0 to 70 mol %.

The photographic material of the present invention contains an iridium ion in an amount of $10^{-8}$ or more mol per mol of silver halide (based on the amount of silver) therein.

For incorporating an iridium ion into the material, generally employed is a method of adding an aqueous solution of a water-soluble iridium compound (for example, hexachloroiridate(III) salt) to a silver halide emulsion in preparing it. The compound may be added to the aqueous solution of a halide for forming the grains also as an aqueous solution of the compound, or it may be added to the reaction system before formation of silver halide grains, during their formation of them, after their formation of them and before their chemical sensitization. Especially preferred is the addition of the compound thereto during formation of the silver halide grains.

The amount of the iridium ion to be added to the silver halide emulsion is preferably from $10^{-8}$ to $10^{-5}$ mol, more preferably from $10^{-7}$ to $10^{-6}$ mol, per mol of silver halide (per mol of silver) therein.

During formation of the silver halide grains for use in the present invention, a silver halide solvent may be added thereto for the purpose of controlling the growth of the grains. Such solvent include, for example, ammonia, potassium rhodanide, ammonium rhodanide, thioether compounds (such as those described in U.S. Pat. Nos. 3,271,156, 3,574,628, 3,704,130, 4,297,439, 4,276,374), thione compounds (such as those described in JP-A 53-144319, 53-82408, 55-77737), and amine compounds (such as those described in JP-A 54-100717).

Apart from such a silver halide solvent, also suitable for the purpose of forming the grains are compounds capable of adsorbing to the surfaces of the grains for controlling their crystal habit, such as sensitizing cyanine dyes, tetrazaindene compounds and mercapto compounds.

The emulsion for use in the present invention may be sensitized by various chemical sensitization methods of, for example, sulfur sensitization (e.g., U.S. Pat. Nos. 1,574,944, 2,278,947, 3,021,215, 3,635,717), reduction sensitization (e.g., U.S. Pat. No. 2,518,698, Research Disclosure, Vol. 176 (December, 1978), 17643, Item 3), thioether compound sensitization (e.g., U.S. Pat. Nos. 2,521,926, 3,021,215, 3,046,133, 3,165,552, 3,625,697, 3,635,717, 4,198,240), or composite sensitization of them.

Chemical sensitizing agents suitable for the sensitization methods include, for example, sulfur sensitizing agents such as sodium thiosulfate, allyl thiocarbamide, thiourea, thiosulfate, thioether and cystine; and reduction sensitizing agents such as tin chloride, phenylhydrazine and reductone.

The emulsion for use in the present invention is preferably gold-sensitized (for example, U.S. Pat. Nos. 2,540,085, 2,399,083). Examples of gold sensitizing agent include potassium chloroaurate, aurous thiosulfate and potassium chloropalladate. The gold compound may be added to the emulsion before addition of a sulfur sensitizing agent or after addition of it. They may be added thereto simultaneously.

The amount of the gold sensitizing agent to be used in the present invention is preferably from $10^{-7}$ to $10^{-3}$ mol, more preferably from $10^{-6}$ to $10^{-4}$ mol, per mol of the silver halide to be sensitized.

The sensitizing dyes to be used for spectral sensitization of the emulsion of the present invention to be sensitive to rays falling within the range of from 600 to 700 nm include, for example, those described in *Research Disclosure,* Item 17643, IV-A (December, 1978, page 23), ibid., Item 1831, IX (August, 1979, page 437) or the references referred to therein.

For instance, advantageously selected are trinuclear cyanine dyes described in JP-A 50-62425, 54-18726, 59-102229, and thiacarbocyanines described in JP-B 48-42172, 51-9609, 55-39818 and JP-A 62-284343.

General formulae and specific examples are shown below:

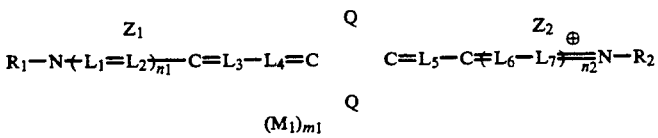

(I)

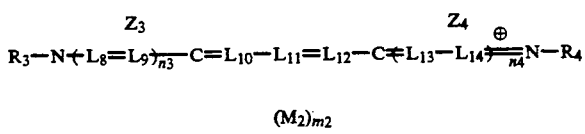

(II)

In formulae (I) and (II), $R_1$, $R_2$, $R_3$ and $R_4$ each represent an alkyl group. $Z_1$, $Z_2$, $Z_3$ and $Z_4$ each represent an atomic group necessary for forming a 5-membered or 6-membered nitrogen-containing heterocyclic group. Q and Q' together form an atomic group necessary for forming a 5-membered or 6-membered nitrogen-containing heterocyclic group. $L_1$, $L_2$, $L_3$, $L_4$, $L_5$, $L_6$, $L_7$, $L_8$, $L_9$, $L_{10}$, $L_{11}$, $L_{12}$, $L_{13}$ and $L_{14}$ each represent a methine group. $n_1$, $n_2$, $n_3$ and $n_4$ each represent 0 or 1. $M_1$ and $M_2$ each represent a charge-neutralizing ion; and $m_1$ and $m_2$ each represent a number of 0 or more which is necessary for neutralizing the charge in the molecule.

Compounds of formulae (I) and (II) will be explained in more detail hereunder.

$R_1$, $R_2$, $R_3$ and $R_4$ each are preferably an unsubstituted alkyl group having 18 or less carbon atoms (e.g., methyl, ethyl, propyl, butyl, pentyl, octyl, decyl, dodecyl, octadecyl), or a substituted alkyl group having 18 or less carbon atoms. Substituents for the substituted alkyl group include, for example, a carboxyl group, a sulfo group, a cyano group, a halogen atom (e.g., fluorine, chlorine, bromine), a hydroxyl group, an alkoxycarbonyl group having 8 or less carbon atoms (e.g., methoxycarbonyl, ethoxycarbonyl, phenoxycarbonyl, benzyloxycarbonyl), an alkoxy group having 8 or less carbon atom (e.g., methoxy, ethoxy, benzyloxy, phenethyloxy), a monocyclic aryloxy group having 10 or less carbon atoms (e.g., phenoxy, p-tolyloxy), an acyloxy group having 3 or less carbon atoms (e.g., acetyloxy, propionyloxy), an acyl group having 8 or less carbon atoms (e.g., acetyl, propionyl, benzoyl, mesyl), a carbamoyl group (e.g., unsubstituted carbamoyl, N,N-dimethylcarbamoyl, morpholinocarbonyl, piperidinocarbonyl), a sulfamoyl group (e.g., unsubstituted sulfamoyl, N,N-dimethylsulfamoyl, morpholinosulfonyl, piperidinosulfonyl), an aryl group having 10 or less carbon atoms (e.g., phenyl, 4-chlorophenyl, 4-methylphenyl, α-naphthyl). Preferably, they each are an unsubstituted alkyl group (e.g., methyl, ethyl, n-propyl, n-butyl, n-pentyl, n-hexyl), a carboxyalkyl group (e.g., 2-carboxyethyl, carboxymethyl), or a sulfoalkyl group (e.g., 2-sulfoethyl, 3-sulfopropyl, 4-sulfobutyl, 3-sulfobutyl).

The nucleus formed by $Z_1$, $Z_2$, $Z_3$ or $Z_4$ includes, for example, thiazole nuclei (for example, unsubstituted thiazole nuclei such as thiazole, 4-methylthiazole, 4-phenylthiazole, 4,5-dimethylthiazole, 4,5-diphenylthiazole; benzothiazole nuclei such as benzothiazole, 4-chlorobenzothiazole, 5-chlorobenzothiazole, 6-chlorobenzothiazole, 5-nitrobenzothiazole, 4-methylbenzothiaozle, 5-methylthiobenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 6-methylthiobenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole, 4-phenylbenzothiazole; naphthothiazole nuclei such as naphtho[2,1-d]thiazole, naptho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole; thiazoline nuclei such as thiazoline, 4-methylthiazoline, 4-nitrothiazoline; oxazole nuclei such as oxazole, 4-methyloxazole, 4-nitrooxazole, 5-methyloxazole, 4-phenyloxazole, 4,5-diphenyloxazole, 4-ethyloxazole; benzoxazole nuclei such as benzoxazole, 5-chlorobenzoxazole, 5-methylbenzoxazole, 5-bromobenzoxazole, 5-fluorobenzoxazole, 5-phenylbenzoxaozle, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole; naphthoxazole nuclei such as naphtho[2,1-d]oxazole, naphtho[1,2-d]oxazole, naphtho[2,3-d]oxazole, 5-nitronaphtho[2,1-d]oxazole; oxazoline nuclei such as 4,4-dimethyloxazole; selenazole nuclei such as selenazole, 4-methylselenaozle, 4-nitroselenazole, 4-phenylselenazole; benzoselenazole nuclei such as benzoselenazole, 5-chlorobenzoselenazole, 5-nitrobenzoselenaozle, 5-methoxybenzoselenazole, 5-hydroxybenzoselenazole, 6-nitrobenzoselenazole, 5-chloro-6-nitrobenzoselenazole, 5,6-dimethylbenzoselenazole; naphthoselenazole nuclei such as naphtho[2,1-d]selenazole, naphtho[1,2-d]selenazole; selenazoline nuclei such as selenazoline, 4-methylselenazoline; tellurazole nuceli such as tellurazole, 4-methyltellurazole, 4-phenyltellurazole; benzotellurazole nuclei such as benzotellurazole, 5-chlorobenzotellurazole, 5-methylbenzotellurazole, 5,6-dimethylbenzotellurazole, 6-methoxybenzotellurazole; naphthotellurazole nuclei such as naphtho[2,1-d]tellurazole, naphtho[1,2-d]tellurazole; tellurazoline nuclei such as tellurazoline, 4-methyltellurazoline; 3,3-dialkylindolenine nuclei such as 3,3-dimethylindolenine, 3,3-diethylindolenine, 3,3-dimethyl-5-cyanoindolenine, 3,3-dimethyl- 6-nitroindolenine, 3,3-diethyl-5-nitroindolenine, 3,3-dimethyl-5-methoxyindolenine, 3,3,5-trimethylindolenine, 3,3-dimethyl-5-chloroindolenine; imidazole nuclei such as imidazole, 1-alkylimidazole, 1-alkyl-4-phenylimidazole, 1-arylimidazole; benzimidazole nuclei such as 1-alkylbenzoimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6 dichlorobenzimidazole, 1-aryl-5-methoxybenzimidazole, 1-aryl-5-cyanobenzimidazole; naphthoimidazole nuclei such as 1-alkylnaphtho[1,2-d]imidazole, 1-arylnaphtho[1,2-d]imidazole; the alkyl group being one having from 1 to 8 carbon atoms, for example, preferably an unsubstituted alkyl group such as methyl, ethyl, propyl, isopropyl, butyl, or a hydroxylalkyl group such as 2-hydroxyethyl, 3-hydroxypropyl, especially preferably methyl, ethyl; the aryl group being phenyl, halogen (e.g., chlorine)-substituted phenyl, alkyl (e.g., methyl)-substituted phenyl, alkoxy (e.g., methoxy)-substituted phenyl; as well as pyridine nuclei such as 2-pyridine, 4-pyridine, 5-methyl-2-pyridine, 3-methyl-4-pyridine; quinoline nuclei such as 2-quinoline, 3-methyl-2-quinoline, 5-ethyl-2-qinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline; isoquinoline nuclei such as 6-nitro-1-isoquinoline, 3,4-dihydro-1-isoquinoline, 6-nitro-3-isoquinoline; imidazo[4,5-b]quinoxaline nuclei such as i,3-diethylimidazo[4,5-b]quinoxaline, 6-chloro-1,3-diallyimidazo[4,5-b]quinoxaline; and oxadiazole nuclei, thiadiazole nuclei, tetrazole nuclei and pyrimidine nuclei.

Nuclei to be formed by $Z_1$, $Z_2$, $Z_3$ or $Z_4$ are preferably thiazole nuclei, benzothiazole nuclei, naphthothiazole nuclei, benzoxazole nuclei, naphthoxazole nuclei, benzimidazole nuclei, 2-quinoline nuclei, and 4-quinoline nuclei.

The 5-membered or 6-membered nitrogen-containing hetero ring to be formed by Q and Q' is one derived from an acidic nucleus by removing therefrom an oxo or thioxo group as positioned at a pertinent position in the nucleus.

The acidic nucleus is to be a resonance terminal of general merocyanine dyes and includes, for example, those mentioned in T. H. James, *The Theory of the Photographic Process*, 4th Ed., Chap. 8, pages 198 to 200 (published by MacMillan Co., 1977).

Acidic nuclei will be explained in detail hereunder.

Substituents which participate in resonance of an acidic nucleus are, for example, preferably a carbonyl group, a cyano group, a sulfonyl group and a sulfinyl group.

An acidic nucleus forms a 5-membered or 6-membered hetero ring composed of carbon, nitrogen and/or chalcogen (typically, oxygen, sulfur, selenium, tellurium) atoms. Preferred examples thereof are nuclei of 2-pyrazolin-5-one, pyrazolidine-3,5-dione, imidazolin-5-one, hydantoin, 2- or 4-thiohydantoin, 2-iminoxazolidin-4-one, 2-oxazolin-5-one, 2-thioxaozlidine-2,4-dione, isoxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1, 1-dioxide, indolin-2-one, indolin-3-one, indazolin-3-one, 2-oxoindazolinium, 3-oxaindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, and pyrido[1,2-a]pyrimidine-1,3-dione.

More preferred are nuclei of rhodanine, 2-thioxazolidine-2,4-dione, and 2-thiohydantoin.

As substituents to be bonded to the nitrogen atom of constituting the nuclei, preferred are a hydrogen atom, an alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group (e.g., aralkyl group such as benzyl, 2-phenylethyl; hydroxyalkyl group such as 2-hydroxyethyl, 3-hydroxypropyl; carboxyalkyl group such as 2-carboxyethyl, 3-carboxypropyl, 4-carboxybutyl, carboxymethyl; alkoxyalkyl group such as 2-methoxyethyl, 2-(2-methoxyethoxy)ethyl; sulfoalkyl group such as 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl; sulfatoalkyl group such as 3-sulfatopropyl, 4-sulfatobutyl; ring-substituted alkyl group such as 2-(pyrroldin-2-on-1-yl)ethyl, tetrahydrofuryl, 2-morpholinoethyl; 2-acetoxyethyl, carbomethoxymethyl, 2-methanesulfonylaminoethyl), an allyl group, an aryl group (e.g., phenyl, 2-naphthyl), a substituted aryl group (e.g., 4-carboxyphenyl, 4-sulfophenyl, 3-chlorophenyl, 3-methylphenyl), and a heterocyclic group (e.g., 2-pyridyl, 2-thiazolyl).

More preferred are an unsubstituted alkyl group (e.g., methyl, ethyl, n-propyl, n-butyl, n-pentyl, n-hexyl), a carboxyalkyl group (e.g., carboxymethyl, 2-carboxyethyl), and a sulfoalkyl group (e.g., 2-sulfoethyl).

$L_1$, $L_2$, $L_3$, $L_4$, $L_5$, $L_6$, $L_7$, $L_8$, $L_9$, $L_{10}$, $L_{11}$, $L_{12}$, $L_{13}$ and $L_{14}$ each are a methine group, or a substituted methine group, for example, substituted by a substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperazino) and/or an alkylthio group (e.g., methylthio, ethylthio). They may form a ring along with other methine group(s), or they may also form a ring along with auxochrome(s).

$L_3$, $L_5$, $L_{10}$ and $L_{12}$ each are preferably an unsubstituted methine group. $L_4$ is preferably an unsubstituted methine group or a substituted methine group substituted by unsubstituted alkyl group(s) (e.g., methyl, ethyl).

$L_{11}$ is preferably an unsubstituted methine group or a substituted methine group substituted by a lower alkyl group (preferably having from 1 to 4 carbon atoms, e.g., methyl, ethyl, propyl, butyl), a lower alkoxy group (preferably having from 1 to 4 carbon atoms, e.g., methoxy, ethoxy, propoxy, butoxy), a phenyl group, a benzyl group and/or a phenethyl group. More preferably, it is a substituted methine group substituted by methyl, ethyl, propyl, benzyl and/or phenyl groups.

$(M_1)_{m1}$ and $(M_2)_{m2}$ each are in the formula so as to show the presence or absence of cation(s) or anion(s) therein, to the extent necessary for neutralizing the ionic charge of the dye. Whether the dye has cation(s) or anion(s) or net ion charge(s), depends upon the auxochrome(s) and substituent(s) therein. Specific cations are inorganic or organic ammonium ions (e.g., triethylammonium ion, pyridinium ion) and alkali metal ions (e.g., sodium ion, potassium ion). Anions may be either inorganic anions or organic anions, including, for example, halide anions (e.g., fluoride ion, chloride ion, bromide ion, iodide ion), substituted arylsulfonato ions (e.g., p-toluenesulfonato ion, p-chlorobenzenesulfonato ion), aryldisulfonato ions (e.g., 1,3-benzenesulfonato ion, 1,5-naphthalenedisulfonato ion, 2,6-naphthalenedisulfonato ion), alkylsulfato ions (e.g., methylsulfato ion), sulfato ion, thiocyanato ion, perchlorato ion, tetrafluoroborato ion, piclinato ion, acetato ion and trifluoromethanesulfonato ion.

Of them, preferred are ammonium ions (e.g., triethylammonium ion, pyridinium ion), alkali metal ions (e.g., sodium ion, potassium ion), iodide ion and p-toluenesulfonato ion.

Specific examples of compounds of formulae (I) and (II) are shown below, which, however, are not limiting.

A-1

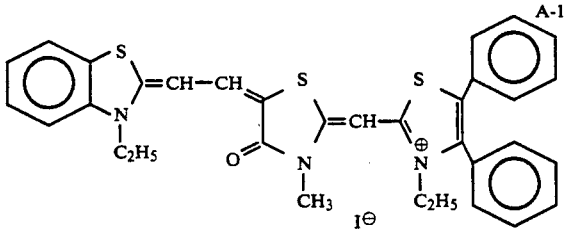

A-2

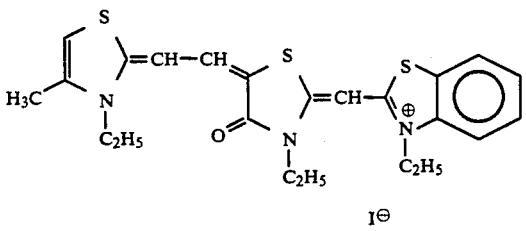

A-3

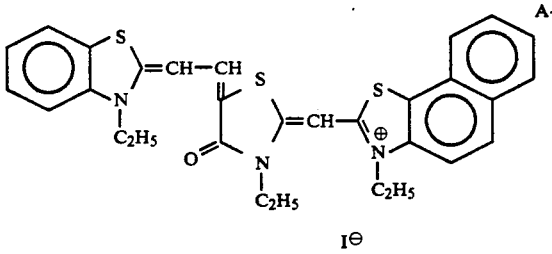

A-4

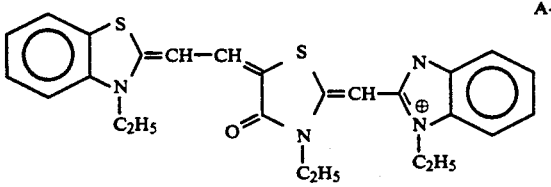

A-5

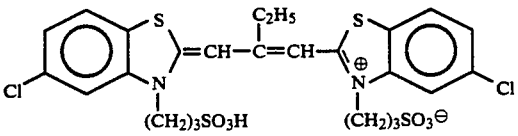

-continued

A-6

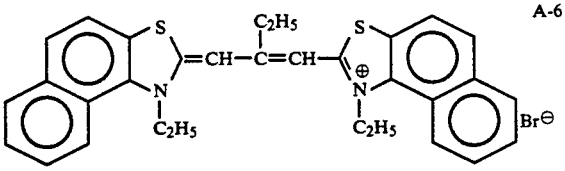

A-7

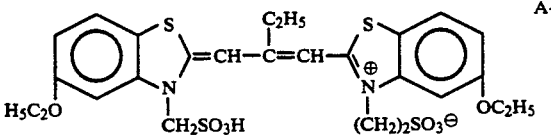

A-8

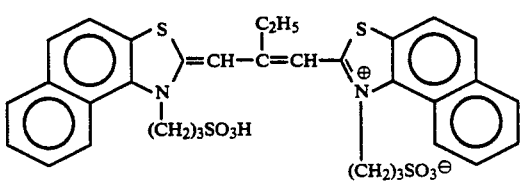

A-9

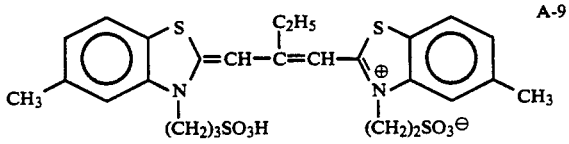

A-10

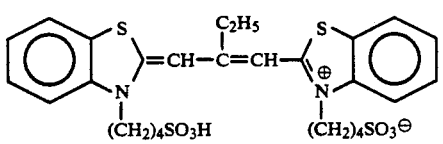

A-11

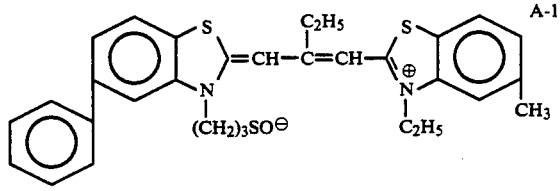

A-12

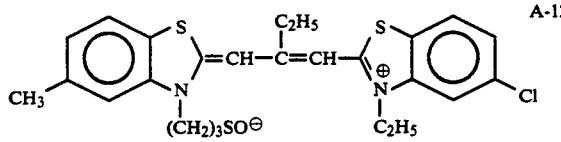

Sensitizing dyes of formula (III) which are sensitive to rays falling within the range of from 600 to 700 nm and are used in the second embodiment of the present invention are explained below.

In formula (III), $R_1$ and $R_2$ each are preferably an unsubstituted alkyl group having 18 or less carbon atoms (e.g., methyl, ethyl, propyl, butyl, pentyl, octyl, decyl, dodecyl, octadecyl), or a substituted alkyl group. The alkyl moiety of the substituted alkyl group has 18 or less carbon atoms and may be substituted by substituent(s) selected from, for example, a carboxyl group, a sulfo group, a cyano group, a halogen atom (e.g., fluorine, chlorine, bromine), a hydroxyl group, an alkoxycarbonyl group having 8 or less carbon atoms (e.g., methoxycarbonyl, ethoxycarbonyl, phenoxycarbonyl, benzyloxycarbonyl), an alkoxy group having 8 or less carbon atoms (e.g., methoxy, ethoxy, benzyloxy, phenethyloxy), a monocyclic aryloxy group having 10 or less carbon atoms (e.g., phenoxy, p-tolyloxy), an acyloxy group having 3 or less carbon atoms (e.g., acetyloxy, propionyloxy), an acyl group having 8 or less carbon atoms (e.g., acetyl, propionyl, benzoyl, mesyl), a carbamoyl group (e.g., unsubstituted carbamoyl, N,N-dimethylcarbamoyl, morpholinocarbonyl, piperidinocarbonyl), a sulfamoyl group (e.g., unsubstituted sulfamoyl, N,N-dimethylsulfamoyl, morpholinosulfonyl, piperidinosulfonyl), and an aryl group having 10 or less carbon atoms (e.g., phenyl, 4-chlorphenyl, 4-methylphenyl, α-naphthyl).

Preferably, they each are an unsubstituted alkyl group (e.g., methyl, ethyl, n-propyl, n-butyl, n-pentyl, n-hexyl), a carboxyalkyl group (e.g., 2-carboxyethyl, carboxymethyl), or a sulfoalkyl group (e.g., 2-sulfoethyl, 3-sulfopropyl, 4-sulfobutyl, 3-sulfobutyl).

$L_1$, $L_2$ and $L_3$ each are a methine group, or a substituted methine group, for example, substituted by a substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperazino) and/or an alkylthio group (e.g., methylthio, ethylthio). They may form a ring along with other methine group(s), or they may also form a ring along with auxochrome(s).

$L_1$ and $L_3$ each are preferably an unsubstituted methine group. $L_2$ is preferably an unsubstituted methine group, or a substituted methine group as substituted by unsubstituted alkyl group(s) (e.g., methyl, ethyl, propyl). More preferably, it is an ethyl-substituted methine group.

$(M_1)_{m1}$ is in the formula so as to show the presence or absence of cation(s) or anion(s) therein, if necessary for neutralizing the ionic charge of the dye. Whether the dye has cation(s) or anioh(s) or net ion charge(s), depends upon the auxochrome(s) and substituent(s) therein. Specific cations are inorganic or organic ammonium ions (e.g., triethylammonium ion, pyridinium ion) and alkali metal ions (e.g., sodium ion, potassium ion, calcium ion). Anions may be either inorganic anions or organic anions, including, for example, halide anions (e.g., fluoride ion, chloride ion, bromide ion, iodide ion), substituted arylsulfonato ions (e.g., p-toluenesulfonato ion, p-chlorobenzenesulfonato ion), aryldisulfonato ions (e.g., 1,3-benzenesulfonato ion, 2,6-naphthalenedisulfonato ion), alkylsulfato ions (e.g., methylsulfato ion), sulfato ion, thiocyanato ion, perchlorato ion, tetrafluoroborato ion, piclinato ion, acetato ion and trifluoromethanesulfonato ion.

Of them, preferred are triethylammonium ion, pyridinium ion, iodide ion, p-toluenesulfonato ion, and alkali metal ions (e.g., sodium ion, potassium ion).

$V_1$, $V_2$, $V_3$, $V_4$, $V_5$, $V_6$, $V_7$ and $V_8$ each are a hydrogen atom or a monovalent substituent, satisfying the following conditions.

Where f value of Vk (k=1 to 8) is Vkf, $A_1 = V_1f + V_2f + V_3f + V_4f$, and $A_2 = V_5f + V_6f + V_7f + V_8f$;

then $A_1 < 1.63$, or $A_2 < 1.63$.

Preferably, $A_1 < 1.63$ and $A_2 < 1.63$. Especially preferably, $A_1 < 1.33$ or $A_2 < 1.33$; and further preferably $A_1 < 1.33$ and $A_2 < 1.33$.

More preferably, $A_1 \leqq 1.06$ or $A_2 \leqq 1.06$; and especially preferably, $A_1 1.06$ and $A_2 1.06$.

The f value is explained below. Vkf value means a calculated value of the partition coefficient of substituents $V_1$ to $V_8$ by the fragment method described in the following reference: C. Hansch & A. J. Leo, *Substituent Constants for Correlation Analysis in Chemistry and Biology* (published by John Wiley Co., New York, 1979). For the partial structure having no description of the f value thereof, the value may be obtained by measurement in accordance with the method described in the above reference.

Preferred examples of the monovalent substituent for $V_1$ to $V_8$, are a halogen atom (e.g., chlorine, fluorine, bromine), an unsubstituted alkyl group preferably having 6 or less carbon atoms (e.g., methyl, ethyl), a substituted alkyl group preferably having 10 or less carbon atoms (e.g., benzyl, α-naphthylmethyl, 2-phenylethyl, trifluoromethyl), an acyl group preferably having 10 or less carbon atoms (e.g., acetyl, benzoyl, mesyl), an acyloxy group preferably having 10 or less carbon atoms (e.g., acetoxy), an alkoxycarbonyl group preferably having 10 or less carbon atoms (e.g., methoxycarbonyl, ethoxycarbonyl, benzyloxycarbonyl), a carbamoyl group preferably having 10 or less carbon atoms (e.g., unsubstituted carbamoyl, N,N-dimethylcarbamoyl, N-butylcarbamoyl, morpholinocarbonyl, piperidinocarbonyl), a sulfamoyl group preferably having 10 or less carbon atoms (e.g., unsubstituted sulfamoyl, N,N-dimethylsulfamoyl, morpholinosulfonyl, piperidinosulfonyl), a carboxyl group, a cyano group, a hydroxy group, an amino group, an acylamino group preferably having 8 or less carbon atoms (e.g., acetylamino), an alkoxy group preferably having 10 or less carbon atoms (e.g., methoxy, ethoxy, benzyloxy), an aryl group (e.g., phenyl, tolyl), a ureido group preferably having 10 or less carbon atoms (e.g., N-methylureido), a heterocyclic group (e.g., 2-pyridyl, 2-thiazolyl), an alkylthio group preferably having 10 or less carbon atoms (e.g., methylthio, ethylthio), and a thiocyanato group. These monovalent substituents may further be substituted.

$V_1$ to $V_8$ each are especially preferably a hydrogen atom, an unsubstituted alkyl group having 3 or less carbon atoms (e.g., methyl, ethyl), an alkoxy group having 3 or less carbon atoms (e.g., methoxy, ethoxy), a halogen atom (e.g., fluorine), a hydroxyl group, a carboxyl group, an acyl group having 3 or less carbon atoms (e.g., acetyl), an acyloxy group having 3 or less carbon atoms (e.g., acetoxy), an alkoxycarbonyl group having 3 or less carbon atoms (e.g., methoxycarbonyl), a carbamoyl group having 5 or less carbon atoms (e.g., N,N-dimethylcarbamoyl, N-butylcarbamoyl), a sulfamoyl group having 3 or less carbon atoms (e.g., N,N-dimethylsulfamoyl), an acylamino group having 3 or less carbon atoms (e.g., acetylamino), an ureido group having 3 or less carbon atoms (e.g., N-methylureido), an alkylthio group having 3 or less carbon atoms (e.g., methylthio), or a thiocyanato group.

More preferably, $V_1$, $V_2$, $V_4$, $V_5$, $V_6$ and $V_8$ are all hydrogen atoms, and $V_3$ and $V_7$ are both fluorine atoms.

Specific examples of compounds of formula (III) for use in the present invention are shown below, which, however, are not limiting.

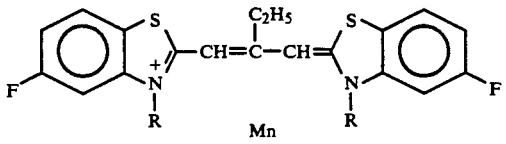

$V_1f = V_2f = V_4f = V_5f = V_6f = V_8f = 0.23$ $V_3f = V_7f = 0.37$ $A_1 = A_2 = 1.06$

| Compound | R | M | n |
|---|---|---|---|
| B-1 | $(CH_2)_2SO_3^-$ | $Na^+$ | 1 |
| B-2 | " | $HN(C_2H_5)_3^+$ | 1 |
| B-3 | $(CH_2)_3SO_3^-$ | $Na^+$ | 1 |
| B-4 | " | $HN(C_2H_5)_3^+$ | 1 |
| B-5 | " | 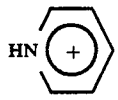 | 1 |
| B-6 | $(CH_2)_4SO_3^-$ | $Na^+$ | 1 |
| B-7 | " | $HN(C_2H_5)_3^+$ | 1 |
| B-8 | " | 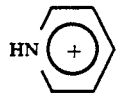 | 1 |
| B-9 | $(CH_2)_2CH(CH_3)-SO_3^-$ | $Na^+$ | 1 |
| B-10 | " | $HN(C_2H_5)_3^+$ | 1 |
| B-11 | " | $K^+$ | 1 |
| B-12 | $CH_2CO_2H$ | $I^-$ | 1 |
| B-13 | $(CH_2)_2CO_2H$ | $Br^-$ | 1 |
| B-14 | $(CH_2)_3CO_2H$ | $I^-$ | 1 |
| B-15 | $CH_2CONHSO_2CH_3$ | $Br^-$ | 1 |
| B-16 | $(CH_2)_3CONHSO_2CH_3$ | $I^-$ | 1 |
| B-17 | $(CH_2)_2CONHSO_2CH_3$ | $I^-$ | 1 |
| B-18 | $CH_3$ | $I^-$ | 1 |
| B-19 | $C_2H_5$ | $I^-$ | 1 |
| B-20 | $C_5H_{11}$ | $I^-$ | 1 |

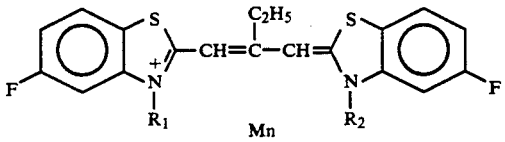

$A_1 = A_2 = 1.06$

| Compound | $R_1$ | $R_2$ | M | n |
|---|---|---|---|---|
| B-21 | $C_2H_5$ | $(CH_2)_4SO_3^-$ | — | — |
| B-22 | " | $(CH_2)_2CH(CH_3)SO_3^-$ | — | — |
| B-23 | " | $(CH_2)_3SO_3^-$ | — | — |
| B-24 | $(CH_2)_4SO_3^-$ | $(CH_2)_2CH(CH_3)SO_3^-$ | $Na^+$ | — |
| B-25 | $CH_2CONHSO_2CH_3$ | $(CH_2)_4SO_3^-$ | — | — |
| B-26 | " | $(CH_2)_3SO_3^-$ | — | — |
| B-27 | " | $(CH_2)_2CH(CH_3)SO_3^-$ | — | — |
| B-28 | $CH_2CO_2H$ | $(CH_2)_4SO_3^-$ | — | — |
| B-29 | " | $(CH_2)_3SO_3^-$ | — | — |

-continued

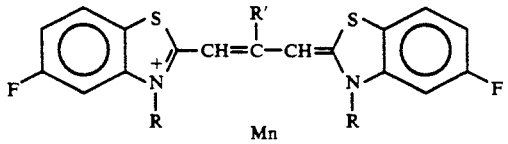

$A_1 = A_2 = 1.06$

| Compound | R' | R | M | n |
|---|---|---|---|---|
| B-30 | $CH_3$ | $(CH_2)_4SO_3^-$ | $Na^+$ | 1 |
| B-31 | " | $(CH_2)_3SO_3^-$ | " | " |
| B-32 | " | $(CH_2)_2CH(CH_3)SO_3^-$ | " | " |
| B-33 | $(CH_2)_2CH_3$ | $(CH_2)_4SO_3^-$ | " | " |
| B-34 | " | $(CH_2)_3SO_3^-$ | " | " |
| B-35 | 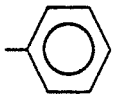 | " | " | " |
| B-36 | " | $(CH_2)_4SO_3^-$ | " | " |
| B-37 | $CH_2CH_2CO_2H$ | " | " | " |
| B-38 | 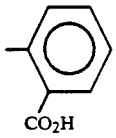 | " | " | " |

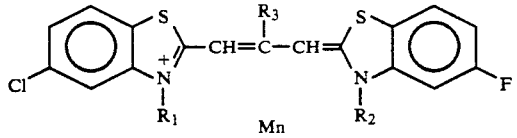

$V_1f = V_2f = V_4f = V_5f = V_6f = V_8f = 0.23$
$V_3f = 0.94$ $V_7f = 0.37$
$A_1 = 1.63$ $A_2 = 1.06$

| Compound | $R_1$ | $R_2$ | $R_3$ | M | n |
|---|---|---|---|---|---|
| B-39 | $(CH_2)_3SO_3^-$ | $(CH_2)_3SO_3^-$ | $C_2H_5$ | $Na^{+1}$ | |
| B-40 | $(CH_2)_4SO_3^-$ | $(CH_2)_4SO_3^-$ | " | " | " |
| B-41 | $(CH_2)_2CH(CH_3)SO_3^-$ | $(CH_2)_2CH(CH_3)SO_3^-$ | " | " | " |
| B-42 | $(CH_2)_2SO_3^-$ | $(CH_2)_2SO_3^-$ | " | $HN(C_2H_5)_3$ | " |
| B-43 | $CH_2CO_2H$ | $CH_2CO_2H$ | " | $I^-$ | " |
| B-44 | $C_2H_5$ | $(CH_2)_4SO_3^-$ | " | — | — |
| B-45 | $(CH_2)_4SO_3^-$ | $(CH_2)_4SO_3^-$ | $CH_3$ | $Na^+$ | 1 |
| B-46 | $CH_2CONHSO_2CH_3$ | $(CH_2)_4SO_3^-$ | $C_2H_5$ | — | — |
| B-47 | $C_2H_5$ | $C_2H_5$ | " | $Br^-$ | 1 |

B-48

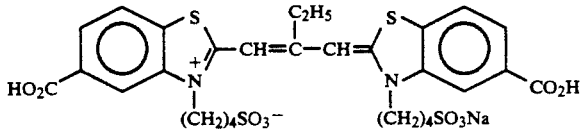

$V_1f = V_2f = V_4f = V_5f = V_6f = V_8f = 0.23$ $V_3f = V_7f = -0.03$ $A_1 = A_2 = 0.66$

B-49

-continued
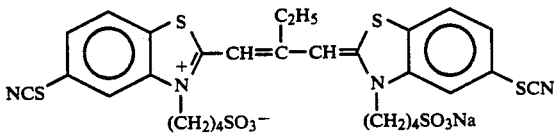
$V_1f = V_2f = V_4f = V_5f = V_6f = V_8f = 0.23$ $V_3f = V_7f = 0.64$ $A_1 = A_2 = 1.33$
B-50
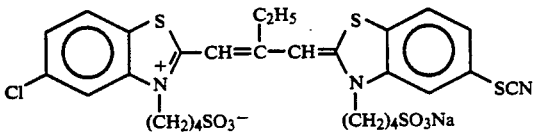
$A_1 = 1.63$ $A_2 = 1.33$
B-51
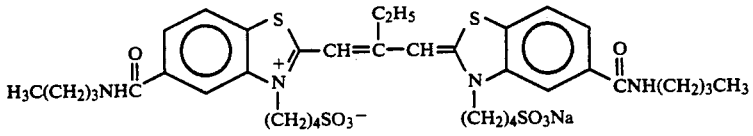
$V_1f = V_2f = V_4f = V_5f = V_6f = V_8f = 0.23$ $V_3f = V_7f = 0.58$ $A_1 = A_2 = 1.27$
B-52
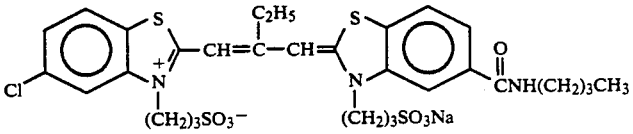
$A_1 = 1.63$ $A_2 = 1.27$
B-53
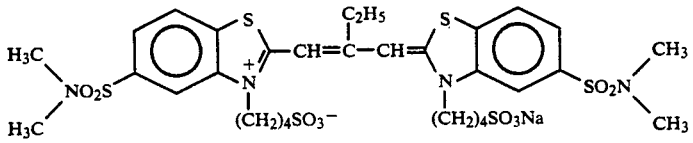
$V_1f = V_2f = V_4f = V_5f = V_6f = V_8f = 0.23$ $V_3f = V_7f = -0.28$ $A_1 = A_2 = 0.41$
B-54
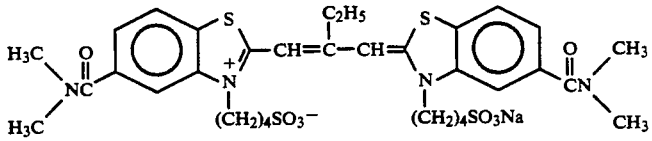
$V_1f = V_2f = V_4f = V_5f = V_6f = V_8f = 0.23$ $V_3f = V_7f = -1.26$ $A_1 = A_2 = -0.57$
B-55
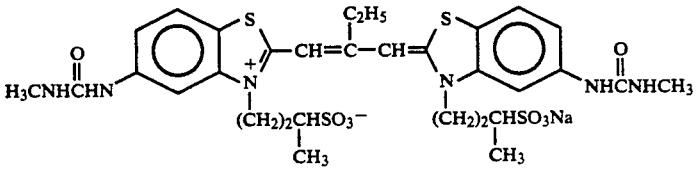
$V_1f = V_2f = V_4f = V_5f = V_6f = V_8f = 0.23$ $V_3f = V_7f = -0.8$ $A_1 = A_2 = -0.11$
B-56

-continued

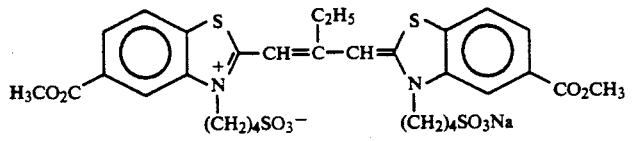

$V_1f = V_2f = V_4f = V_5f = V_6f = V_8f = 0.23$ $V_3f = V_7f = 0.21$ $A_1 = A_2 = 0.9$

B-57

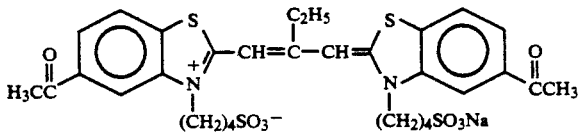

$V_1f = V_2f = V_4f = V_5f = V_6f = V_8f = 0.23$ $V_3f = V_7f = -0.32$ $A_1 = A_2 = 0.37$

B-58

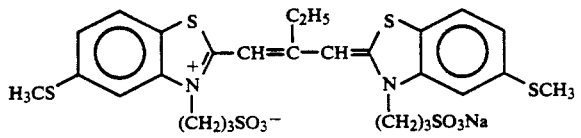

$V_1f = V_2f = V_4f = V_5f = V_6f = V_8f = 0.23$ $V_3f = V_7f = 0.8$ $A_1 = A_2 = 1.49$

The sensitizing dyes of the present invention can be produced in accordance with the methods described in F. M. Harmer, Heterocyclic Compounds, Cyanine Dyes and Related Compounds (published by John Wiley & Sons Co., New York, London, 1964).

The sensitizing dyes of the present invention may be used singly or in combination of them or may also be used in combination with any other sensitizing dyes. A combination of sensitizing dyes is often employed for the purpose of super-color sensitization. The emulsion of constituting the photographic material of the present invention can contain, along with the sensitizing dye(s), dyes which do not have spectral sensitizing effect by themselves or substances which do not substantially absorb visible rays but show super-color sensitization.

Useful sensitizing dyes, combinations thereof with dyes showing super-color sensitization, and substances of showing super-color sensitization are described in *Research Disclosure,* Vol. 176, No. 17643 (issued December 1978), page 23, IV-J and in JP-B 49-25500, 43-4933, and JP-A 59-19032, 59-192242.

The amount of the sensitizing dye(s) in the photographic material of the present invention is desirably selected to be optimal, in accordance with the grain size and halogen composition of the silver halide grains in the emulsion, the method and degree of chemical sensitization of the grains, and the kind of the antifoggant to be in the material. The test method for selecting the amount is well known by anyone skilled in the art. Preferably, in general, it is from $10^{-7}$ mol to $1\times10^{-2}$ mol, especially preferably from $10^{-6}$ to $5\times10^{-3}$ mol, per mol of silver halide.

The sensitizing dyes of the present invention can be dispersed directly into the silver halide emulsion for constituting the photographic material of the present invention. If desired, they may first be dissolved in a suitable solvent such as methyl alcohol, ethyl alcohol, methyl cellosolve, acetone, water, pyridine or a mixture thereof, and the resulting solution may be added to the emulsion. The time of adding the dyes is generally after chemical sensitization of the emulsion, but they may also be added during formation of the emulsion grains or before chemical sensitization. Dissolution of the dyes may also be effected ultrasonically.

Various compounds may be added to the photographic material of the present invention for the purpose of preventing lowering of the sensitivity of the material or fogging of the material during manufacture, storage or processing.

As such compounds, an extremely large number of compounds have been known, including, for example, heterocyclic compounds such as nitrobenzeneimidazole, ammonium chloroplatinate, 4-hydroxy-6-methyl-1,3,3a,7-tetrazaindene, 1-phenyl-5-mercaptotetrazole, as well as other mercury-containing compounds, mercapto compounds and metal salts. Some examples of suitable compounds are described in references as referred to in C. E. K. Mees, *The Theory of the Photographic Process,* 3rd Ed., 1966, pages 344 to 349. For instance, there are mentioned thiazolium salts described in U.S. Pat. Nos. 2,131,038, 2,649,716; azaindenes described in U.S. Pat. Nos. 2,886,437, 2,444,605; urazoles described in U.S. Pat. No. 3,287,135; sulfocatechols described in U.S. Pat. Nos. 3,236,652; oximes described in British Patent 623,448; mercaptotetrazoles, nitrons and nitroindazoles described in U.S. Pat. Nos. 2,403,927, 3,266,897, 3,397,987; polyvalent metal salts described in U.S. Pat. No. 2,839,405; thiuronium salts described in U.S. Pat. No. 3,220,839; and palladium, platinum or gold salts described in U.S. Pat. Nos. 2,566,263 and 2,597,915.

In particular, polyhydroxybenzene compounds are preferred as they are effective for lowering fogging and improving pressure resistance, without detracting from the sensitivity. Polyhydroxybenzene compounds are desired to have any of the following structures:

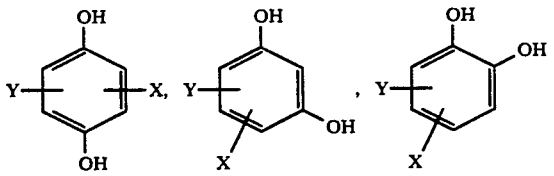

In these formulae, X and Y each represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each are —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3K$, $—SO_3H$, $—SCH_3$,

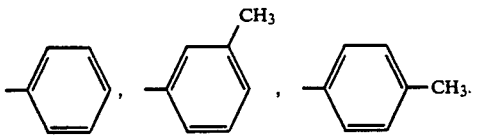

X and Y may be same or different.

Especially preferred polyhydroxy compounds are shown below:

C-1

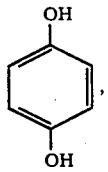

C-2

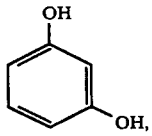

C-3

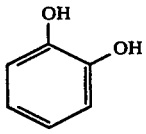

C-4

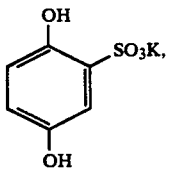

C-5

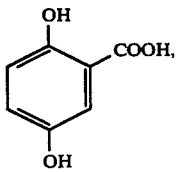

-continued

C-6

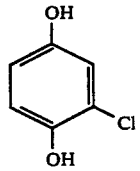

C-7

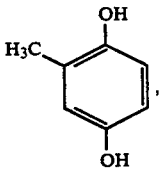

C-8

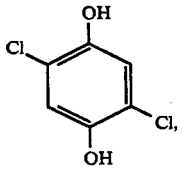

C-9

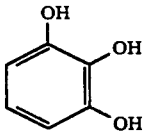

C-10

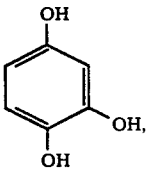

C-11

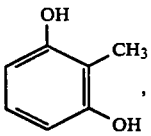

C-12

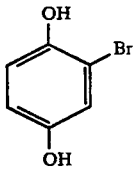

C-13

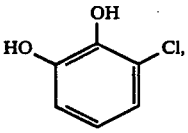

C-14

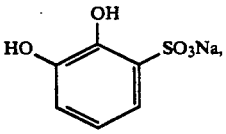

C-15

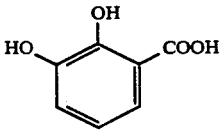

-continued

C-16

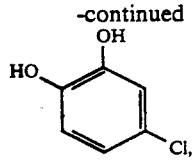

C-17

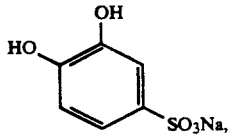

C-18

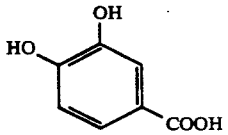

C-19

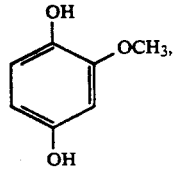

C-20

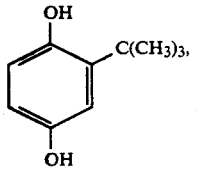

C-21

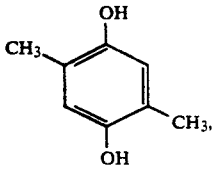

C-22

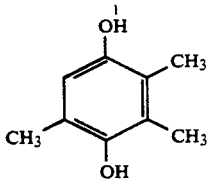

Polyhydroxybenzene compounds may be added to the emulsion layers or any other layers constituting the photographic material of the present invention. The amount to be added is effectively from $10^{-5}$ to 1 mol, especially effectively from $10^{-3}$ mol to $10^{-1}$ mol, per mol of silver halide.

The photographic material of the present invention can contain water-soluble dyes as a filter dye or for anti-irradiation or for any other purpose, in the hydrophilic colloid layers constituting the material. Such dyes include, for example oxonole dyes, hemioxonole dyes, styryl dyes, merocyanine dyes, cyanine dyes and azo dyes. Especially effective are oxonole dyes, hemioxonole dyes and merocyanine dyes.

The photographic material of the present invention can contain surfactants in the photographic emulsion layers or in any other hydrophilic colloid layers, for purposes of coating aid, prevention of static charges, improvement of slide property, emulsification and dispersion aid, prevention of surface sticking and improvement of photographic characteristics (for example, for promotion of developability, elevation of hard contrast, elevation of sensitivity).

As an antistatic agent suitable for the purpose, preferred are fluorine-containing surfactants or polymers described in U.S. Pat. No. 4,201,586, JP-A 60-80849, 59-74554, 62-109044, and 62-215272; nonionic surfactants described in JP-A 60-76742, 60-80846, 60-80848, 60-80839, 60-76741, 58-208743, 62-172343, 62-173459, and 62-215272; and nonionic, anionic, cationic or amphoteric electroconductive polymers or latexes as described in JP-A 57-204540 and 62-215272. As an inorganic antistatic agent, preferably suitable are electroconductive tin oxide, zinc oxide or antimony-doped composite metal oxides thereof described in JP-A 57-118242.

The photographic material of the present invention may contain a hardening agent. Suitable examples of hardening agents include aldehyde compounds such as mucochloric acid, mucobromic acid, mucophenoxychloric acid, mucophenoxybromic acid, formaldehyde, dimethylolurea, trimethylol melamine, glyoxal, monomethyl glyoxal, 2,3-dihydroxy-1,4-dioxane, 2,3-dihydroxy-5-methyl-1,4-dioxane, succinaldehyde, 2,5-dimethoxytetrahydrofuran and glutaraldehyde; active vinyl compounds such as divinylsulfone, methylene-bismaleimide, 5-acetyl-1,3-diacryloyl-hexahydro-s-triazine, 1,3,5-triacryloyl-hexahydro-s-triazine, 1,3,5-trivinylsulfonylhexahydro-s-triazine bis(vinylsulfonylmethyl) ether, 1,3-bis(vinylsulfonylmethyl)propanol-2-bis(α-vinylsulfonylacetamido)ethane; active halogen compounds such as 2,4-dichloro-6-hydroxy-s-triazine sodium salt, 2,4-dichloro-6-methoxy-s-triaizne, 2,4-dichloro-6-(4-sulfoanilino)-s-triazine sodium salt, 2,4-dichloro-6-(2-sulfoethylamino)-s-triazine, N,N'-bis(2-chloroethylcarbamoyl)piperazine; epoxy compounds such as bis(2,3-epoxypropyl)methylpropylammonium p-toleuensulfonate, 1,4-bis(2',3'-epoxypropyloxy)butane, 1,3,5-triglycidyl isocyanurate, 1,3-diglycidyl-5-(γ-acetoxy-β-oxypropyl)isocyanurate; ethyleneimine compounds such as 2,4,6-triethyleneimino-s-triazine, 1,6-hexamethylene-N,N'-bisethyleneurea, bis-β-ethyleneiminoethylthioether; methanesulfonate ester compounds such as 1,2-di(methanesulfonoxy)ethane, 1,4-di(methanesulfonoxy)butane, 1,5-di(methanesulfonoxy)pentane; and carbodiimide compounds; isoxazole compounds; and inorganic compounds such as chromium alum.

The photographic material of the present invention can contain, as a mat agent, organic compounds such as polymethyl methacrylate homopolymer or methyl methacrylate-methacrylic acid copolymer, or starch; or fine grains of inorganic compounds such as silica, titanium dioxide, strontium sulfate or barium as described in U.S. Pat. Nos. 2,992,101, 2,701,245, 4,142,894, and 4,396,706. The grain size of the mat agent is desirably from 1 to 10 μm, especially preferably from 2 to 5 μm.

The surface layer of the photographic material of the present invention can contain, as a lubricant agent, silicone compounds described in U.S. Pat. Nos. 3,489,576 and 4,047,958; colloidal silica described in JP-B 56-23139, as well as paraffin wax, higher fatty acid esters or starch derivatives.

The photographic material of the present invention can contain, as a plasticizer, polyols such as trimethylol propane, pentanediol, butanediol, ethylene glycol or glycerin, in the hydrophilic colloid layers.

The photographic material of the present invention can contain a polymer latex for the purpose of improving pressure resistance, in the hydrophilic colloid layers. Suitable polymers for this purpose include alkyl acrylate homopolymers, alkyl acrylate-acrylic acid copolymers, styrene-butadiene copolymers, and polymers or copolymers of active methylene monomers.

The photographic material of the present invention has, in addition to the light-sensitive silver halide emulsion layers, non-light-sensitive layers such as surface protective layer, interlayer, anti-halation layer and backing layer.

The number of the silver halide emulsion layers constituting the photographic material of the present invention may be two or more; and the sensitivity and gradation of a plurality of silver halide emulsion layers may be different from one another. If desired, the material may be one or more silver halide layers and non-light-sensitive layers on the both surfaces of the support.

As the support of the photographic material of the present invention, preferred is a polyethylene terephthalate film or cellulose triacetate film. It is especially preferably colored in blue. The surface of the support is desired to be pre-treated by corona discharging, glow discharging or ultraviolet irradiation, for the purpose of elevating the adhesiveness to the hydrophilic colloid layers to be coated thereover. If desired, a subbing layer composed of a styrene-butadiene latex or vinylidene chloride latex may be provided on the support, or a gelatin layer may be superposed thereover. A subbing layer composed of a polyethylene swelling agent and a gelatin-containing organic solvent may also be provided on the support. The subbing layer may optionally be surface-treated, whereby the adhesiveness to the hydrophilic colloid layers to be coated thereover may be further elevated.

The silver halide emulsion layer, interlayer, protective layer, antihalation layer and backing layer of constituting the photographic material of the present invention can contain, as a binder, gelatin as well as an acylated gelatin such as phthalated gelatin or malonated gelatin; a cellulose compound such as hydroxyethyl cellulose or carboxymethyl cellulose; a soluble starch such as dextrin; and a hydrophilic polymer such as polyvinyl alcohol, polyvinyl pyrrolidone, polyacrylamide or polystyrene-sulfonic acid. Above all, preferred is a combination of gelatin and dextran and polyacrylamide as a binder.

The total gelatin amount on the silver halide emulsion layer side of the support is preferably 3.5 g/m$^2$ or less, more preferably 3.3 g/m$^2$ or less, especially preferably 3.0 g/m$^2$ or less.

The silver amount in the silver halide emulsion layers as coated per one surface of the support is 2.8 g/m$^2$ or less, preferably 2.6 g/m$^2$ or less, more preferably 2.5 g/m$^2$ or less.

The weight ratio of silver to gelatin in the silver halide emulsion layers constituting the photographic material of the present invention is an important factor for the rapid processability of the material. When it is elevated, the coated emulsion layers peel off from the support due to the projections of the roller, in processing the material with an automatic processor, to cause formation of rough images (so-called emulsion pick-off). From that viewpoint, the weight ratio of silver to gelatin in the silver halide emulsion layers coated is desirably 1.4 or less, more preferably 1.2 or less, especially preferably 1.1 or less.

The developer to be used for processing the photographic material of the present invention can contain any known developing agent. As the developing agent, usable are dihydroxybenzenes (e.g., hydroquinone) and 3-pyrazolidones (e.g., 1-phenyl-3-pyrazolidone), aminophenols (e.g., N-methyl-p-aminophenol). These may be used singly or in combination. The developer generally contains, in addition to the developing agent, a preservative, an alkali agent, a pH buffer and an antifoggant. If desired, it may further contain a dissolution aid, a toning agent, a development accelerator (e.g., quaternary salts, hydrazine, benzyl alcohol), a surfactant, a defoaming agent, a water softener, a hardening agent (e.g., glutaraldehyde) and a tackifier.

For fixing the developed material, any conventional fixer may be used. Suitable fixing agents include, for example, thiosulfates, thiocyanates and other organic sulfur compounds known to be useful as a fixing agent. The fixer may contain a water-soluble aluminum salt as a hardening agent.

The photographic material of the present invention may be processed with an automatic processor. Preferably used is a roller-conveying type automatic processor as described in U.S. Pat. Nos. 3,025,779, 3,515,556, 3,573,914, 3,647,459, and British Patent 1,269,268.

The development temperature is desirably from 18° C. to 50° C., especially preferably from 30° C. to 45° C. The development time is desirably from 6 seconds to 40 seconds, especially preferably from 6 seconds to 25 seconds.

The time for the total process from initiation of development to finish of drying, through fixation and rinsing, is generally from 25 seconds to 200 seconds, preferably from 25 seconds to 100 seconds. Where the photographic material of the present invention is processed, the total processing time may be from 25 seconds to 60 seconds, advantageously. The total processing time means a dry to dry time, that is, the time from the beginning of dipping the top end of the photographic material to be processed in the developer tank to the finish of taking out the top end of the same from the drying zone.

For development of the photographic material of the present invention, the procedures of JP-A 2-103037, from page 16, line 7 of the right top column to page 19, line 15 of the left bottom column, and JP-A 2-115837, from page 3, line 5 of the right bottom column to page 6, line 10 of the right top column, may be used to.

The present invention will be explained in more detail by way of the following examples, which, however, are not intended to restrict the scope of the present invention.

EXAMPLE 1

1. Preparation of Silver Halide Emulsions:

1) Preparation of Silver Halide Emulsion A:

32 g of gelatin was dissolved in one liter of water, put in a container and heated up to 70° C. To this were added 1.2 g of potassium bromide and 92 mg of compound (I) of:

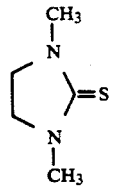

444 ml of an aqueous solution containing 80 g of silver nitrate and 452 ml of an aqueous solution containing 56.3 g of potassium bromide were added thereto by a double-jet method over a period of about 20 minutes to form silver bromide cores. 400 ml of an aqueous solution containing 80 g of silver nitrate and 415 ml of an aqueous solution containing 56.2 g of potassium bromide and $3.5\times10^{-7}$ mol, per mol of silver, of potassium hexachloroiridate(III) were added thereto also by double-jet method over a period of about 25 minutes, to form a monodispersed emulsion of somewhat roundish cubic silver bromide grains having a mean grain size (as diameter or projected area) of 0.36 μm and a fluctuation coefficient of the projected area diameter of 11%.

The emulsion was de-salted, and. 62 g of gelatin and 1.75 g of phenoxyethanol were added thereto. This was adjusted to have pH of 6.5 and pAg of 8.6. This was then heated up to 65° C., and 2 mg of sodium thiosulfate was added thereto. After 2 minutes, 5 mg of chloroauric acid was added thereto. After 80 minutes, 512 mg of 4-hydroxy-6-methyl-1,3,3a,7-tetrazaindene was added thereto. Then, this was rapidly cooled and solidified to obtain Emulsion A.

2) Preparation of Silver Halide Emulsions B to J:

32 g of gelatin was dissolved in one liter of water in a container as heated at 53° C. To this were added 0.3 g of potassium bromide, 5 g of sodium chloride and 46 mg of compound (I). 444 ml of an aqueous solution containing 80 g of silver nitrate and 452 ml of an aqueous solution containing 45 g of potassium bromide, 5.5 g of sodium chloride and potassium hexachloroiridate(III) of the amount indicated in Table 1 below (as the molar amount of the salt to mol of silver) were added thereto by double-jet method over a period of about 20 minutes to form cores having a silver chloride content of 20 mol %. 400 ml of an aqueous solution containing 80 g of silver nitrate and 415 ml of an aqueous solution containing 44.8 g of potassium bromide, 5.5 g of sodium chloride and potassium hexachloroiridate(III) of the amount indicated in Table 1 below (as the molar amount of the salt to mol of silver) were added thereto also by a double-jet method over a period of about 25 minutes, to form shells having a silver chloride content of 20 mol %. Thus, a monodispersed emulsion of cubic silver chlorobromide grains having a mean grain size (as diameter of projected area) of 0.35 μm and a fluctuation coefficient of the projected area diameter of 10% was prepared.

The emulsion was de-salted, and 62 g of gelatin and 1.75 g of phenoxyethanol were added thereto. This was adjusted to have pH of 6.5 and pAg of 8.5. This was then heated up to 65° C., and 2 mg of sodium thiosulfate was added thereto. After 2 minutes, 5 mg of chloroauric acid was added thereto. After 80 minutes, 512 mg of 4-hydroxy-6-methyl-1,3,3a,7-tetrazaindene was added thereto. Then, this was rapidly cooled and solidified to obtain Emulsions B to F. In the same manner, Emulsions G to J were prepared, each having the iridium content and the silver chloride content in the core part and the shell part indicated in Table 1 below.

3) Preparation of Silver Halide Emulsion K:

32 g of gelatin was dissolved in one liter of water in a container as heated up to 46° C. To this were added 0.3 g of potassium bromide, 5 g of sodium chloride and 46 g of compound (I). 444 ml of an aqueous solution containing 80 g of silver nitrate and 452 ml of an aqueous solution containing 22.6 g of potassium bromide and 16.4 g of sodium chloride were added thereto by a double-jet method over a period of about 20 minutes to form cores having a silver chloride content of 60 mol %. 400 ml of an aqueous solution containing 80 g of silver nitrate and 415 ml of an aqueous solution containing 22.4 g of potassium bromide, 16.5 g of sodium chloride and $3.5\times10^{-7}$ mol, per mol of silver, of potassium hexachloroiridate(III) were added thereto also by a double-jet method over a period of about 25 minutes to form shells having a silver chloride content of 60 mol %. Thus, a monodispersed emulsion of cubic silver chlorobromide grains having a mean grain size (as diameter of projected area of 0.37 μm and a fluctuation coefficient of the projected area diameter of 12% was prepared.

The emulsion was desalted, and 62 g of gelatin and 1.75 g of phenoxyethanol were added thereto. This was adjusted to have pH of 6.5 and pAg of 7.9. This was thereafter treated in the same manner as in preparation of emulsion B. Thus, Emulsion K was prepared.

2. Preparation of Emulsion Coating Composition:

To one mol of each of Emulsions A to K were added the following chemicals, and an emulsion coating composition was prepared:

| | | |
|---|---|---|
| a. | Sensitizing Dye (I) | 138 mg |
| b. | Sensitizing Dye (II) | 42.5 mg |
| c. | Polyacrylamide (molecular weight 40,000) | 8.54 g |
| d. | Trimethylolpropane | 1.2 g |
| e. | Sodium Polystyrenesulfonate (mean molecular weight 600,000) | 0.46 g |
| f. | Latex of Poly(ethyl acrylate/methacrylic acid) | 32.8 g |
| g. | 1,2-Bis(vinylsulfonylacetamido)ethane | 2 g |
| h. | Potassium Hydroquinonemonosulfonate | 3.9 g |

Sensitizing Dye (I)

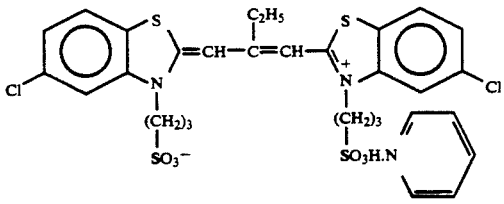

Sensitizing Dye (II)

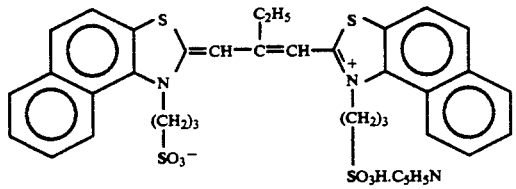

3. Preparation of Coating Composition for Emulsion Layer Protecting Layer:

A container was heated up to 40° C., and the following chemicals were added thereto to prepare a coating composition.

| | | |
|---|---|---|
| a. | Gelatin | 100 g |

-continued

| | | |
|---|---|---|
| b. | Polyacrylamide (molecular weight 40,000) | 12.3 g |
| c. | Sodium Polystyrenesulfonate (molecular weight 600,000) | 0.6 g |
| d. | Fine Polymethyl Methacrylate Grains (mean grain size 2.5 μm) | 2.7 g |
| e. | Sodium Polyacrylate | 3.7 g |
| | Sodium t-octylphenoxyethoxyethanesulfonate | 1.5 g |
| f. | $C_{16}H_{33}O—(CH_2CH_2O)_{10}—H$ | 3.3 g |
| g. | $C_8F_{17}SO_3K$ | 84 mg |
| h. | $C_8F_{17}SO_2N(C_3H_7)(CH_2CH_2O)_4(CH_2)_4—SO_3Na$ | 84 mg |
| i. | NaOH | 0.2 g |
| j. | 1,2-Bis(vinylsulfonylacetamido)ethane 2.3 wt. % to the total gelatin amount in the emulsion layer and the surface protecting layer | |

-continued

| | | |
|---|---|---|
| k. | Compound (II) | 52 mg |

Compound (II)

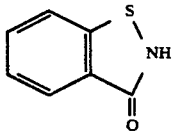

4. Preparation of Backing Layer Coating Composition:

The container was heated up to 40° C. and the following chemicals were added thereto to form a coating composition for forming a backing layer:

| | | |
|---|---|---|
| a. | Gelatin | 100 g |
| b. | Dye I | 2.39 g |

(Dye I)

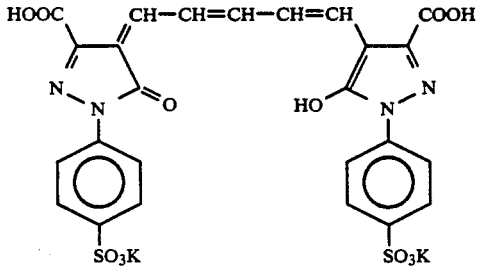

| | | |
|---|---|---|
| c. | Sodium Polystyrenesulfonate (molecular weight 600,000) | 1.1 g |
| d. | Phosphoric Acid | 0.55 g |
| e. | Latex of Poly(ethyl acrylate/methacrylic acid) | 2.9 g |
| f. | Compound (II) | 46 mg |
| g. | Oil Dispersion of Dye II described in JP-A 61-285445 | 246 mg (as dye) |

(Dye II)

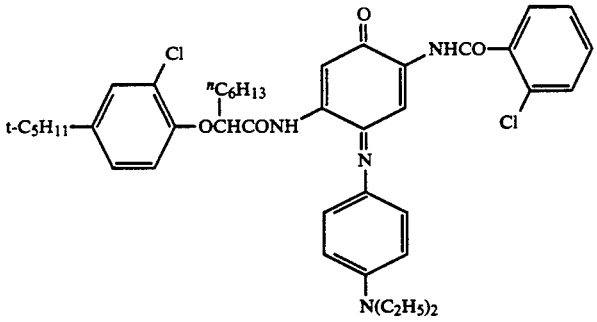

| | | |
|---|---|---|
| h. | Oligomer Surfactant Dispersion of Dye III described in JP-A 62-276539 | 46 mg (as dye) |

(Dye III)

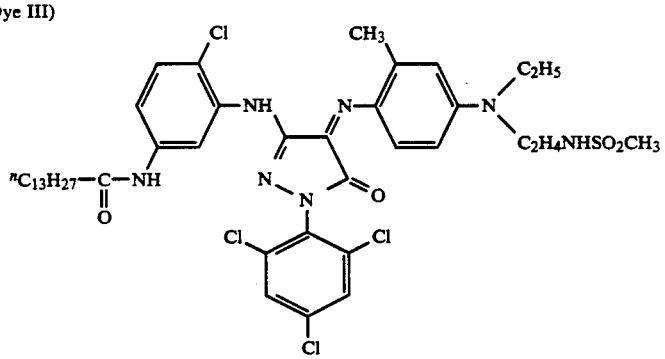

5. Preparation of Coating Composition for Backing Layer Protecting Layer:

A container was heated up to 40° C., and the following chemicals were added thereto to prepare a coating composition.

| | | |
|---|---|---|
| a. | Gelatin | 100 g |
| b. | Sodium Polystyrenesulfonate (molecular weight 600,000) | 0.3 g |
| c. | Fine Polymethyl Methacrylate Grains (mean grain size 3.5 μm) | 4.3 g |
| d. | Sodium t-octylphenoxyethoxyethanesulfonate | 1.8 g |
| e. | Sodium Polyacrylate | 1.7 g |
| f. | $C_{16}H_{33}O—(CH_2CH_2O)10-H$ | 3.6 g |
| g. | $C_8F_{17}SO_3K$ | 268 mg |
| h. | $C_8F_{17}SO_2N(C_3H_7)(CH_2CH_2O)_4(CH_2)_4SO_3Na$ | 45 mg |
| i. | NaOH | 0.3 g |
| j. | Methanol | 131 ml |
| k. | 1,2-Bis(vinylsulfonylacetamido)ethane 2.2 wt. % to the total gelatin amount in the backing layer and the backing surface protecting layer | |
| k. | Compound (II) | 45 mg |

6. Preparation of Photographic Materials:

The backing layer coating composition prepared in the previous step 4 was coated on one surface of a blue-colored polyethylene terephthalate support along with the coating composition for a backing layer protecting layer prepared in the previous step 5, the gelatin amount in the coated backing layer being 2.69 g/m² and that in the coated backing layer protecting layer being 1.13 g/m². Subsequently, the emulsion layer coating composition prepared in the previous step 2 was coated on the opposite surface of the support along with the coating composition for emulsion layer protecting layer prepared in the previous step 3, the Ag amount in the coated emulsion layer being 2.4 g/m², the gelatin amount therein being 1.85 g/m² and the gelatin amount in the emulsion layer protecting layer being 1.2 g/m². Accordingly, photographic material Sample Nos. 1 to 11 were prepared.

7. Sensitometry of Photographic Material Samples:

Photographic material Sample Nos. 1 to 11 thus prepared were subjected to sensitometry in the manner described below, to measure the photographic sensitivity of each.

Precisely, photographic materials Sample Nos. 1 to 11 were stored for 7 days, after coating, under the condition of 25° C. and 60% RH, and the stored samples were then exposed with a 633 nm He-Ne laser exposing means of an exposure Model AC-1 (manufactured by Fuji Photo Film Co., Ltd.).

The exposed samples were then processed with an automatic processor Model FPM-9000 (manufactured by Fuji Photo Film Co., Ltd.), where development was effected with RD-7 at 35° C. and fixation with Fuji F. The electric circuit of the machine was modified so as to control the rotational speed of the rollers, and the samples were processed under two conditions, one being 30 seconds for dry-to-dry procedure and the other being 90 seconds for the same. The sensitivity of each sample was represented by a logarithmic number of the reciprocal of the exposure of yielding D=1.5, as a relative value (relative sensitivity) to the sensitivity of sample No. 1 of being 100 as processed by the condition of dry-to-dry 30 seconds.

8. Evaluation of Fixability:

Sample Nos. 1 to 11 were dipped in a fixer having the composition mentioned below, whereupon the time before the emulsion of each sample was fixed to be transparent was measured with a Hitachi's spectrophotometer (Type U-3210) to evaluate the fixability of each sample. Fixer (mono-bath composition):

| | |
|---|---|
| Ammonium Thiosulfate (70 wt/vol %) | 200 ml |
| Disodium Ethylenediaminetetraacetate Dihydrate | 0.03 g |
| Sodium Thiosulfate Pentahydrate | 10 g |
| Sodium Sulfite | 15 g |
| Boric Acid | 4 g |
| 1-(N,N-dimethylamino)ethyl-5-mercaptotetrazole | 1 g |
| Tartaric Acid | 3.2 g |
| Glacial Acetic Acid | 31.5 g |
| Sodium Hydroxide | 11 g |
| Sulfuric Acid (36N) | 3.9 g |
| Aluminium Sulfate | 10 g |
| Water to make | 1000 ml |
| pH | 4.65 |

The results obtained are shown in Table 1 below.

TABLE 1

| | Emulsion | Silver Chloride Content (mol %) Core | Silver Chloride Content (mol %) Shell | Iridium Content (mol/mol of Ag) Core | Iridium Content (mol/mol of Ag) Shell | Relative Sensitivity (dry-to-dry 30 seconds) | Relative Sensitivity (dry-to-dry 90 seconds) | Fixation Time (sec) |
|---|---|---|---|---|---|---|---|---|
| No. 1 (comparative sample) | A | 0 | 0 | 0 | $3.5 \times 10^{-7}$ | 100 | 126 | 7.4 |
| No. 2 (comparative sample) | B | 20 | 20 | 0 | 0 | 162 | 331 | 6.9 |
| No. 3 (sample of the invention) | C | 20 | 20 | 0 | $3.5 \times 10^{-7}$ | 138 | 155 | 6.9 |
| No. 4 (sample of the invention) | D | 20 | 20 | 0 | $1.7 \times 10^{-7}$ | 199 | 251 | 6.9 |
| No. 5 (sample of the invention) | E | 20 | 20 | $0.8 \times 10^{-7}$ | $1.7 \times 10^{-7}$ | 158 | 182 | 6.9 |
| No. 6 (sample of the invention) | F | 20 | 20 | $1.7 \times 10^{-7}$ | $1.7 \times 10^{-7}$ | 123 | 135 | 6.9 |
| No. 7 (sample of the invention) | G | 20 | 40 | 0 | $3.5 \times 10^{-7}$ | 126 | 155 | 6.6 |
| No. 8 (sample of the invention) | H | 10 | 10 | 0 | $3.5 \times 10^{-7}$ | 120 | 138 | 7.1 |

TABLE 1-continued

| | Emulsion | Silver Chloride Content (mol %) Core | Silver Chloride Content (mol %) Shell | Iridium Content (mol/mol of Ag) Core | Iridium Content (mol/mol of Ag) Shell | Relative Sensitivity (dry-to-dry 30 seconds) | Relative Sensitivity (dry-to-dry 90 seconds) | Fixation Time (sec) |
|---|---|---|---|---|---|---|---|---|
| No. 9 (sample of the invention) | I | 30 | 30 | 0 | $3.5 \times 10^{-7}$ | 151 | 174 | 6.7 |
| No. 10 (sample of the invention) | J | 40 | 40 | 0 | $3.5 \times 10^{-7}$ | 126 | 155 | 6.5 |
| No. 11 (comparative sample) | K | 60 | 60 | 0 | $3.5 \times 10^{-7}$ | 76 | 182 | 6.1 |

From the results in Table 1 above, it is noted that the samples having a higher silver chloride content could be fixed in a shorter period of time, but where the silver chloride content therein was 60 mol % or more, the relative sensitivity noticeably lowered. Further, the sample not containing iridium had a high relative sensitivity, but the difference in the sensitivity of the iridium-free sample between the processing conditions of dry-to-dry 90 seconds and dry-to-dry 30 seconds was great. Thus, the iridium-free sample had poor developability with respect to the rate of development and was therefore unsuitable for rapid processing.

From the results, the superiority of the photographic material samples of the present invention over the comparative samples is obvious.

EXAMPLE 2

Photographic material Sample Nos. 12 to 20 were prepared in the same manner as in Example 1, except that the gelatin amount in the de-salted emulsion C was varied in such a way that the coated Ag amount and gelatin amount and the ratio of Ag to gelatin in each sample were as those shown in Table 2 below.

Sample Nos. 12 to 20 were evaluated in the manner described below:

1) Evaluation of Emulsion Pick-off Resistance:

Sample Nos. 12 to 20 were stored immediately after coating, under the condition of 25° C. and 60% RH for 7 days and then exposed with a 633 nm He-Ne laser to have the maximum density. These were then processed with FPM-9000 (manufactured by Fuji Photo Film Co., Ltd.), using RD-7 (at 35° C.) and Fuji F, for dry-to-dry 45 seconds. The number of emulsion pick-off faults in the area of $16 \times 30$ cm$^2$ of each processed sample was counted with the naked eye by the use of an illuminator in a dark room.

FPM-9000 as used herein is one which has been previously modified in such a way that the squeeze rollers are worn to easily yield emulsion pick-up faults in the rinsed samples.

Evaluation of emulsion pick-off resistance was effected on the basis of the following criteria:

A: Several emulsion pick-off faults;

B: Ten-odd emulsion pick-off faults;

C: 20 to 50 emulsion pick-off faults; and

D: More than 50 emulsion pick-off faults

A and B indicate a practical level.

2) Evaluation of Fixability:

Sample Nos. 12 to 20 were developed without exposure. The development was effected with FPM-9000 (manufactured by Fuji Photo Film Co., Ltd.), using RD-7 for development at 35° C. and Fuji F for fixation. The electric circuit of the automatic processor was modified so as to control the rotational speed of the rollers. The samples were processed under two conditions, one being 30 seconds for dry-to-dry procedure and the other being 90 seconds for the same. For evaluation of the fixability of each sample, the clearness of each fixed sample was measured with a densitometer and the fixability was expressed as the difference between the density of the sample processed for dry-to-dry 30 seconds and that of the same sample processed for dry-to-dry 90 seconds. The larger the difference, the poorer the clearness by fixation.

The results obtained are shown in Table 2 below.

TABLE 2

| | Coated Silver Amount (g/m$^2$) | Coated Gelatin Amount (g/m$^2$) | Ratio of Silver to Gelatin | Fixability (difference of density between dry-to-dry 30 seconds and dry-to-dry 90 seconds) | Emulsion Pick-off Resistance |
|---|---|---|---|---|---|
| No. 12 (comparative sample) | 3.3 | 2.54 | 1.3 | 0.15 | A |
| No. 13 (comparative sample) | 3.3 | 2.00 | 1.65 | 0.09 | D |
| No. 14 (comparative sample) | 3.0 | 2.31 | 1.3 | 0.10 | B |
| No. 15 (comparative sample) | 3.0 | 2.00 | 1.5 | 0.05 | C |
| No. 16 (sample of the invention) | 2.8 | 2.16 | 1.3 | 0.02 | A |
| No. 17 (sample of the invention) | 2.8 | 2.00 | 1.4 | 0.01 | B |
| No. 18 (sample of the | 2.6 | 2.00 | 1.3 | 0 | B |

TABLE 2-continued

| | Coated Silver Amount ($g/m^2$) | Coated Gelatin Amount ($g/m^2$) | Ratio of Silver to Gelatin | Fixability (difference of density between dry-to-dry 30 seconds and dry-to-dry 90 seconds) | Emulsion Pick-off Resistance |
|---|---|---|---|---|---|
| invention) | | | | | |
| No. 19 (sample of the invention) | 2.6 | 2.36 | 1.1 | 0.02 | B |
| No. 20 (sample of the invention) | 2.4 | 2.36 | 1.0 | 0 | A |

As is obvious from the results in Table 2 above, the samples of the present invention had excellent fixability and excellent emulsion pick-off resistance.

From the results, the superiority of the samples of the present invention over the comparative samples is obvious.

Since the photographic material of the present invention has a light-sensitive emulsion layer having a silver chloride content of from 10 mol % to 50 mol %, containing an iridium compound in an amount of $10^{-8}$ mol or more, per mol of silver in the silver halide in the layer, and comprising silver halide grains as spectrally-sensitized to be sensitive to a wavelength range of from 600 to 700 nm and has a coated silver amount of 2.8 $g/m^2$ or less, it has a high sensitivity and is suitable for rapid processing due to the high rate of development thereof.

EXAMPLE 3

1. Preparation of Silver Halide Emulsion A':

32 g of gelatin was dissolved in one liter of water, put in a container, and heated up to 53° C. To this were added 0.3 g of potassium bromide, 5 g of sodium chloride and 46 mg of compound (I) (the same as in Example 1). 444 ml of an aqueous solution containing 80 g of silver nitrate and 452 ml of an aqueous solution containing 45 g of potassium bromide, 5.5 g of sodium chloride and $7\times10^{-7}$ mol, to mol of silver, of potassium hexachloroiridate(III) were added thereto by a double-jet method over a period of about 20 minutes to form cores having a silver chloride content of 20 mol %. 400 ml of an aqueous solution containing 80 g of silver nitrate and 415 ml of an aqueous solution containing 46.4 g of potassium bromide, 5.7 g of sodium chloride and $1.7\times10^{-7}$ mol, to mol of silver, of potassium hexachloroiridate(III) were added thereto also by double-jet method over a period of about 25 minutes, to form shells having a silver chloride content of 17 mol %. Thus, a monodispersed emulsion of cubic silver chlorobromide grains having a mean grain size (as diameter or projected area) of 0.35 μm and a fluctuation coefficient of the projected area diameter of 10% was obtained.

The emulsion was de-salted, and 62 g of gelatin and 1.75 g of phenoxyethanol were added thereto. This was adjusted to have pH of 6.5 and pAg of 8.5.

This was then heated up to 65° C., and 2 mg of sodium thiosulfate was added thereto. After 2 minutes, 5 mg of chloroauric acid was added thereto. After 80 minutes, 512 mg of 4-hydroxy-6-methyl-1,3,3a,7-tetrazaindene was added thereto. Then, this was rapidly cooled and solidified to obtain Emulsion A'.

2. Preparation of Emulsion Coating Composition:

To one mol of emulsion A' were added the following chemicals, and an emulsion coating composition was prepared:

| | | |
|---|---|---|
| a. | Sensitizing Dye (1) Comparative Dyes D, E, F or G, or Illustrated Compound B-3, B-6 or B-30 | Amount shown in Table 3 |
| b. | Sensitizing Dye (2) | Amount shown in Table 3 |

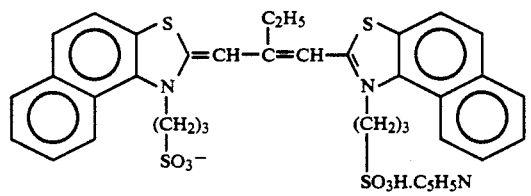

$V_1f = V_2f = 0.23$ $V_3f + V_4f = 1.44$ $A_1 = A_2 = 1.90$

| | | |
|---|---|---|
| c. | Polyacrylamide (molecular weight 40,000) | 85.4 g |
| d. | Trimethylolpropane | 1.2 g |
| e. | Sodium Polystyrenesulfonate (mean molecular weight 600,000) | 0.46 g |
| f. | Latex of Poly(ethyl acrylate/methacrylic acid) | 32.8 g |
| g. | 1,2-Bis(vinylsulfonylacetamido)ethane | 2 g |
| h. | Potassium Hydroquinonemonosulfonate | 3.9 g |

Comparative Dyes:

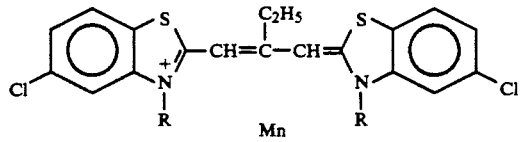

$A_1 = A_2 = 1.63$

| Compound | R | M | n |
|---|---|---|---|
| D | $(CH_2)_3SO_3^-$ | Na | 1 |
| E | $(CH_2)_4SO_3^-$ | Na | 1 |

-continued

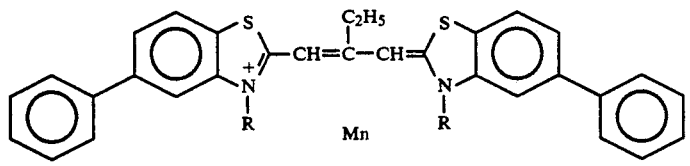

$V_1f = V_2f = V_4f = V_5f = V_6f = V_8f = 0.23$ $V_3f = V_7f = 1.90$ $A_1 = A_2 = 2.59$

| Compound | R | M | n |
|---|---|---|---|
| F | $(CH_2)_3SO_3^-$ | Na | 1 |
| G | $(CH_2)_4SO_3^-$ | Na | 1 |

3. Preparation of Coating Composition for Emulsion Layer Protecting Layer:

A container was heated up to 40° C., and the following chemicals were added thereto to prepare a coating composition:

| | | |
|---|---|---|
| a. | Gelatin | 100 g |
| b. | Polyacrylamide (molecular weight 40,000) | 12.3 g |
| c. | Sodium Polystyrenesulfonate (molecular weight 600,000) | 0.6 g |
| d. | Fine Polymethyl Methacrylate Grains (mean grain size 2.5 μm) | 2.7 g |
| e. | Sodium Polyacrylate | 3.7 g |
| f. | Sodium t-octylphenoxyethoxyethanesulfonate | 1.5 g |
| g. | $C_{16}H_{33}O—(CH_2CH_2O)_{10}—H$ | 3.3 g |
| h. | $C_8F_{17}SO_3K$ | 84 mg |
| i. | $C_8F_{17}SO_2N(C_3H_7)(CH_2CH_2O)_4(CH_2)_4—SO_3Na$ | 84 mg |
| j. | NaOH | 0.2 g |
| k. | Methanol | 78 cc |
| l. | 1,2-Bis(vinylsulfonylacetamido)ethane 2.3 wt. % to the total gelatin amount in the emulsion layer and the surface protecting layer | |
| m. | Compound (II) (the same as in Example 1) | 52 mg |

4. Preparation of Backing Layer Coating Composition:

The container was heated up to 40° C., and the following chemicals were added thereto to form a coating composition for forming a backing layer:

| | | |
|---|---|---|
| a. | Gelatin | 100 g |
| b. | Dye I | 2.39 g |
| c. | Sodium Polystyrenesulfonate (molecular weight 600,000) | 1.1 g |
| d. | Phosphoric Acid | 0.55 g |
| e. | Latex of Poly(ethyl acrylate/methacrylic acid) | 2.9 g |
| f. | Compound (II) (the same as in Example 1) | 46 mg |
| g. | Oil Dispersion of Dye II described in JP-A 61-285445 | 246 mg (as dye) |
| h. | Oligomer Surfactant Dispersion of Dye III described in JP-A 62-276539 | 46 mg (as dye) |

Dyes I, II and III used herein are the same as in Example 1.

5. Preparation of Coating Composition for Backing Layer Protecting Layer:

A container was heated up to 40° C., and the following chemicals were added thereto to prepare a coating composition:

| | | |
|---|---|---|
| a. | Gelatin | 100 g |
| b. | Sodium Polystyrenesulfonate (molecular weight 600,000) | 0.3 g |
| c. | Fine Polymethyl Methacrylate Grains (mean grain size 3.5 μm) | 4.3 g |
| d. | Sodium t-octylphenoxyethoxyethanesulfonate | 1.8 g |
| e. | Sodium Polyacrylate | 1.7 g |
| f. | $C_{16}H_{33}O—(CH_2CH_2O)_{10}—H$ | 3.6 g |

-continued

| | | |
|---|---|---|
| g. | $C_8F_{17}SO_3K$ | 268 mg |
| h. | $C_8F_{17}SO_2N(C_3H_7)(CH_2CH_2O)_4(CH_2)_4SO_3Na$ | 45 mg |
| i. | NaOH | 0.3 g |
| j. | Methanol | 131 ml |
| k. | 1,2-Bis(vinylsulfonylacetamido)ethane 2.2 wt. % to the total gelatin amount in the backing layer and the backing surface protecting layer | |
| k. | Compound (II) | 45 mg |

6. Preparation of Photographic Materials:

The backing layer coating composition prepared in the previous step 4 was coated on one surface of a blue-colored polyethylene terephthalate support along with the coating composition for backing layer protecting layer prepared in the previous step 5. The gelatin amount in the coated backing layer was 2.69 g/m² and that in the coated backing layer protecting layer was 1.13 g/m². Subsequently, the emulsion layer coating composition prepared in the previous step 2 was coated on the opposite surface of the support along with the coating composition for emulsion layer protecting layer prepared in the previous step 3. The Ag amount in the coated emulsion layer was 2.4 g/m², the gelatin amount therein was 1.85 g/m² and the gelatin amount in the emulsion layer protecting layer being 1.2 g/m². Accordingly, photographic material Sample Nos. 1b to 15b were prepared.

7. Sensitometry of Photographic Material Samples:

The photographic material samples thus prepared were subjected to sensitometry in the manner mentioned below, to measure the photographic sensitivity of each of them.

Precisely, the photographic materials samples were stored for 7 days, after coating, under the condition of 25° C. and 60% RH. The stored samples were then exposed with a 633 nm He-Ne laser exposing means of an exposure Model AC-1 (manufactured by Fuji Photo Film Co., Ltd.).

The exposed samples were then processed with a photographic processor Model CEPROS-M (manufactured by Fuji Photo Film Co., Ltd.), using a developer of CE-D1.F1 at 35° C., for 45 seconds of dry-to-dry procedure. The sensitivity of each sample was represented by the relative value (relative sensitivity) to the sensitivity of sample No. 1b of being 100.

8. Evaluation of Residual color:

Photographic material Sample Nos. 1b to 15b were developed without exposure by the use of an automatic processor Model FPM-9000 (manufactured by Fuji Photo Film Co., Ltd.), where development was effected with RD-7 at 35° C. and fixation with Fuji F. The electric circuit of the automatic processor was modified so as to control the rotation speed of the rollers, and the samples were processed for 30 seconds of dry-to-dry procedure.

For evaluating the residual color in each of the processed samples, the absorbance of the sample was measured with a Hitachi's spectrophotometer (Type U-3410) to obtain the maximum peak wavelength (λmax) of the sensitizing dye as remained in the processed sample. On the basis of the absorbance value thus measured, the residual color in the sample was evaluated.

The larger the absorbance value, the larger the residual color. Samples having a larger residual color are unfavorable.

The results obtained are shown in Table 3 below.

From the results, the superiority of the samples of the present invention over the comparative samples is obvious.

EXAMPLE 4

1. Preparation of Silver Halide Emulsions:

1) Preparation of Silver Halide Emulsions B' and C':

32 g of gelatin was dissolved in one liter of water and put in a container as heated up to 70° C. To this were added 1.2 g of potassium bromide and 92 mg of the above-mentioned compound (I). 444 ml of an aqueous solution containing 80 g of silver nitrate and 452 ml of an aqueous solution containing 56.3 g of potassium bromide were added thereto by a double-jet method over a period of about 20 minutes to form cores of silver bromide. 400 ml of an aqueous solution containing 80 g of silver nitrate and 415 ml of an aqueous solution containing 56.2 g of potassium bromide and potassium hexachloroiridate(III) of the molar amount, to mol of silver, indicated in Table 4 below were added thereto also by a double-jet method over a period of about 25 minutes, to prepare a monodispersed emulsion of somewhat roundish cubic silver bromide grains having a mean grain size (as diameter or projected area) of 0.36 μm and

TABLE 3

| | Sensitizing Dye (1) | | | | |
|---|---|---|---|---|---|
| | Kind | Amount Added (mol/mol of silver halide) | Amount of Sensitizing Dye (2) Added (mol/mol of silver halide) | Relative Sensitivity (dry-to-dry, 45 seconds) | Residual Color (Absorbance of λmax) |
| No. 1b (comparative sample) | Comparative Dye D | $3.2 \times 10^{-4}$ | 0 | 100 | 0.09 |
| No. 2b (comparative sample) | Comparative Dye D | $1.6 \times 10^{-4}$ | $0.8 \times 10^{-4}$ | 309 | 0.05 |
| No. 3b (comparative sample) | Comparative Dye D | $3.2 \times 10^{-4}$ | $0.8 \times 10^{-4}$ | 372 | 0.09 |
| No. 4b (comparative sample) | Comparative Dye E | $3.2 \times 10^{-4}$ | 0 | 132 | 0.10 |
| No. 5b (comparative sample) | Comparative Dye E | $1.6 \times 10^{-4}$ | $0.8 \times 10^{-4}$ | 380 | 0.06 |
| No. 6b (comparative sample) | Comparative Dye E | $3.2 \times 10^{-4}$ | $0.8 \times 10^{-4}$ | 468 | 0.12 |
| No. 7b (comparative sample) | Comparative Dye F | $3.2 \times 10^{-4}$ | $0.8 \times 10^{-4}$ | 355 | 0.15 |
| No. 8b (comparative sample) | Comparative Dye G | $3.2 \times 10^{-4}$ | $0.8 \times 10^{-4}$ | 426 | 0.16 |
| No. 9b (sample of the invention) | Illustrated Compound (B-3) | $3.2 \times 10^{-4}$ | 0 | 117 | 0.01 |
| No. 10b (sample of the invention) | Illustrated Compound (B-3) | $1.6 \times 10^{-4}$ | $0.8 \times 10^{-4}$ | 355 | 0.02 |
| No. 11b (sample of the invention) | Illustrated Compound (B-3) | $3.2 \times 10^{-4}$ | $0.8 \times 10^{-4}$ | 513 | 0.03 |
| No. 12b (sample of the invention) | Illustrated Compound (B-6) | $3.2 \times 10^{-4}$ | 0 | 282 | 0.01 |
| No. 13b (sample of the invention) | Illustrated Compound (B-6) | $1.6 \times 10^{-4}$ | $0.8 \times 10^{-4}$ | 309 | 0.02 |
| No. 14b (sample of the invention) | Illustrated Compound (B-6) | $3.2 \times 10^{-4}$ | $0.8 \times 10^{-4}$ | 525 | 0.02 |
| No. 15b (sample of the invention) | Illustrated Compound (B-30) | $3.2 \times 10^{-4}$ | $0.8 \times 10^{-4}$ | 234 | 0.02 |

From the results in Table 3 above, it is noted that the samples containing the sensitizing dye of formula (III) of the present invention have a high sensitivity and, after processed, they have little residual color.

Where the sensitizing dye of formula (III) of the present invention is combined with sensitizing dye (2) (as used as a super-spectral sensitizing agent), the photographic materials containing them are noted to have a higher sensitivity and, after processed, they also have little residual color.

a fluctuation coefficient of the projected area diameter of 11%.

The emulsion was de-salted, and 62 g of gelatin and 1.75 g of phenoxyethanol were added thereto. This was adjusted to have pH of 6.5 and pAg of 8.6.

This was then heated up to 65° C., and 2 mg of sodium thiosulfate was added thereto. After 2 minutes, 5 mg of chloroauric acid was added thereto. After 80 minutes, 512 mg of 4-hydroxy-6-methyl-1,3,3a,7-tetrazaindene was added thereto. After rapidly cooled and solidified, emulsions B' and C' were obtained.

2) Preparation of Silver Halide Emulsions D' to G':

Emulsions D' to G' were prepared in the same manner as Emulsion A' in Example 3, except that the amount of potassium hexachloroiridate(III) therein was varied to that indicated in Table 4 below.

2. Preparation of Photographic Material Samples:

An emulsion coating composition, a coating composition for emulsion layer protecting layer, a backing layer coating composition and a coating composition for backing layer protecting layer were prepared in the same manner as in Example 3. Using these layers, photographic material samples were prepared also in the same manner as in Example 3.

The same sensitizing dyes (1) and (2) in the same amounts as those used in preparing Sample No. 15b of Example 3 were used.

Accordingly, photographic material Sample Nos. 16b to 21b were prepared.

3. Sensitometry of Photographic Material Samples:

The photographic material samples thus prepared were subjected to sensitometry in the manner mentioned below, to measure the photographic sensitivity of each of them.

Precisely, the photographic materials samples were stored for 7 days, after coating, under the condition of 25° C. and 60% RH. The stored samples were then exposed with a 633 nm He-Ne laser exposing means of an exposure Model AC-1 (manufactured by Fuji Photo Film Co., Ltd.).

The exposed samples were then processed with a photographic processor Model FPM-9000 (manufactured by Fuji Photo Film Co., Ltd.), where development was effected with RD-7 at 35° C. and fixation with Fuji F. The electric circuit of the machine was modified so as to control the rotational speed of the rollers. The samples were processed under two conditions, one being 30 seconds for dry-to-dry procedure and the other being 90 seconds for the same. The sensitivity of each sample was represented by a logarithmic number of the reciprocal of the exposure of yielding D=1.5, as a relative value (relative sensitivity) to the sensitivity of sample No. 15b of being 100 as processed by the condition of dry-to-dry 30 seconds.

The results obtained are shown in Table 4 below.

TABLE 4

| | Emulsion | Iridium Content (mol/mol of Ag) Cores | Iridium Content (mol/mol of Ag) Shells | Relative Sensitivity (dry-to-dry, 30 seconds) | Relative Sensitivity (dry-to-dry, 90 seconds) |
|---|---|---|---|---|---|
| No. 16b (comparative sample) | B' | 0 | 0 | 96 | 220 |
| No. 17b (sample of the invention) | C' | 0 | $1.7 \times 10^{-7}$ | 144 | 199 |
| No. 18b (comparative sample) | D' | 0 | 0 | 132 | 269 |
| No. 19b (sample of the invention) | E' | 0 | $3.5 \times 10^{-7}$ | 112 | 126 |
| No. 20b (sample of the invention) | F' | 0 | $1.7 \times 10^{-7}$ | 162 | 204 |
| No. 21b (sample of the invention) | G' | $0.8 \times 10^{-7}$ | $1.7 \times 10^{-7}$ | 128 | 148 |
| No. 15b (sample of the invention) | A | $1.7 \times 10^{-7}$ | $1.7 \times 10^{-7}$ | 100 | 110 |

From the results in Table 4 above, it is noted that the samples not containing an iridium compound in the silver halide emulsion layer have a great difference in the sensitivity between the condition of dry-to-dry 90 seconds and the condition of dry-to-dry 30 seconds to cause unevenness of the processed samples and therefore they are not suitable to rapid processing.

Accordingly, it is understood that the photographic material of the present invention of containing an iridium compound in an amount of $10^{-8}$ mol per mol of silver is superior to any other conventional photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a transparent support having on at least one surface thereof a light-sensitive silver halide emulsion layer, wherein the silver halide emulsion contains an iridium compound in an amount of $10^{-8}$ mol or more per mol of silver in the silver halide therein and has been spectrally-sensitized with a sensitizing dye of formula (III):

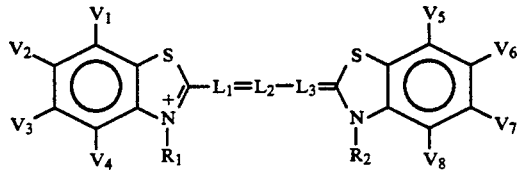

(III)

$(M_1)m_1$ wherein $V_1$, $V_2$, $V_4$, $V_5$, $V_6$, and $V_8$ each represent a hydrogen atom or a monovalent substituent, each of $V_3$ and $V_7$ represents a fluorine atom, and $V_1$, $V_2$, $V_3$, $V_4$, $V_5$, $V_6$, $V_7$ and $V_8$ satisfy the following conditions:

assuming that the f value of Vk (k=1 to 8) is Vkf, $A_1 = V_1f + V_2f + V_3f + V_4f$, and $A_2 = V_5f + V_6f + V_7f + V_8f$;

then $A_1 < 1.63$, or $A_2 < 1.63$;

$R_1$ and $R_2$ each represent a substituted or unsubstituted alkyl group;

$L_1$, $L_2$ and $L_3$ each represent a substituted or unsubstituted methine $M_1$ represents a charge neutralizing pair ion; and $m_1$ is a number of 0 or more, which is necessary for neutralizing the charge of the molecule.

2. A silver halide photographic material as claimed in claim 1, wherein $R_1$ and $R_2$ each independently are an unsubstituted alkyl group, a carboxyalkyl group, or a sulfoalkyl group.

3. A silver halide photographic material as claimed in claim 1, wherein $L_1$ and $L_3$ each are an unsubstituted methine group.

* * * * *